US010884352B2

(12) United States Patent
Yamada et al.

(10) Patent No.: US 10,884,352 B2
(45) Date of Patent: Jan. 5, 2021

(54) ELECTROPHOTOGRAPHIC MEMBER, PROCESS CARTRIDGE AND ELECTROPHOTOGRAPHIC APPARATUS

(71) Applicant: CANON KABUSHIKI KAISHA, Tokyo (JP)

(72) Inventors: Masaki Yamada, Mishima (JP); Hiroaki Komatsu, Fuji (JP); Hideya Arimura, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 127 days.

(21) Appl. No.: 16/365,936

(22) Filed: Mar. 27, 2019

(65) Prior Publication Data

US 2019/0302644 A1 Oct. 3, 2019

(30) Foreign Application Priority Data

Mar. 30, 2018 (JP) ..... 2018-067877

(51) Int. Cl.

| | |
|---|---|
| ***G03G 15/08*** | (2006.01) |
| ***G03G 15/16*** | (2006.01) |
| ***G03G 15/02*** | (2006.01) |
| ***G03G 5/043*** | (2006.01) |

(52) U.S. Cl.

CPC ..... *G03G 15/0818* (2013.01); *G03G 5/043* (2013.01); *G03G 15/0233* (2013.01); *G03G 15/1685* (2013.01)

(58) Field of Classification Search

None

See application file for complete search history.

(56) References Cited

U.S. PATENT DOCUMENTS

| | | | |
|---|---|---|---|
| 7,797,833 | B2 | 9/2010 | Nakamura et al. |
| 7,799,398 | B2 | 9/2010 | Nakamura et al. |
| 8,600,273 | B2 | 12/2013 | Yamada et al. |
| 8,655,222 | B2 | 2/2014 | Nakamura et al. |
| 8,706,011 | B2 | 4/2014 | Anan et al. |
| 8,768,226 | B2 | 7/2014 | Koyanagi et al. |
| 8,768,227 | B2 | 7/2014 | Urushihara et al. |
| 8,774,677 | B2 | 7/2014 | Sakurai et al. |
| 8,798,508 | B2 | 8/2014 | Yamada et al. |
| 8,837,985 | B2 | 9/2014 | Ishida et al. |
| 8,846,287 | B2 | 9/2014 | Yamada et al. |

(Continued)

FOREIGN PATENT DOCUMENTS

| | | |
|---|---|---|
| JP | S57-5047 | 1/1982 |
| JP | H11-209633 | 8/1999 |

(Continued)

*Primary Examiner* — Ramsey Zacharia

(74) *Attorney, Agent, or Firm* — Venable LLP

(57) ABSTRACT

The electrophotographic member includes an electro-conductive substrate, a urethane resin having a structure of structural formula (1), an anion, and a resin particle, and has a protrusion derived from the resin particle on an outer surface thereof, the resin particle contains one or both of a urethane resin and a polyamide resin, the resin layer further contains carbon black, and the carbon black extracted from the resin layer has a BET specific surface area of 33 $m^2/g$ or more and 133 $m^2/g$ or less, and DBP absorption amount at a 70% torque value in DBP absorption measurement of 42 ml/100 g or more and 90 ml/100 g or less.

12 Claims, 4 Drawing Sheets

(56) References Cited

U.S. PATENT DOCUMENTS

| | | | |
|---|---|---|---|
| 8,874,007 | B2 | 10/2014 | Kawamura et al. |
| 8,874,012 | B2 | 10/2014 | Yamada et al. |
| 8,913,930 | B2 | 12/2014 | Ishii et al. |
| 8,968,168 | B2 | 3/2015 | Takeuchi et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,665,028 | B2 | 5/2017 | Arimura et al. |
| 9,811,009 | B2 | 11/2017 | Yamada et al. |
| 9,964,914 | B2 | 5/2018 | Arimura et al. |
| 9,977,353 | B2 | 5/2018 | Nishioka et al. |
| 9,977,359 | B2 | 5/2018 | Koyanagi et al. |
| 10,018,934 | B2 | 7/2018 | Yamada et al. |
| 10,108,129 | B2 | 10/2018 | Yamaguchi et al. |
| 10,197,930 | B2 | 2/2019 | Yamada et al. |
| 2004/0142179 | A1* | 7/2004 | Harada ..... G03G 15/0233 428/413 |
| 2010/0080611 | A1* | 4/2010 | Kurachi ..... G03G 15/0818 399/111 |
| 2015/0331342 | A1 | 11/2015 | Yamaguchi et al. |
| 2015/0331346 | A1 | 11/2015 | Yamauchi et al. |
| 2016/0363881 | A1 | 12/2016 | Urushihara et al. |
| 2017/0329251 | A1 | 11/2017 | Urushihara et al. |
| 2018/0011418 | A1 | 1/2018 | Arimura et al. |
| 2018/0039200 | A1 | 2/2018 | Utsuno et al. |
| 2018/0217551 | A1 | 8/2018 | Arimura et al. |
| 2019/0094741 | A1 | 3/2019 | Uno et al. |

FOREIGN PATENT DOCUMENTS

| | | |
|---|---|---|
| JP | 2003-202722 | 7/2003 |
| JP | 2011-053658 | 3/2011 |
| JP | 2011-118113 | 6/2011 |

* cited by examiner

ELECTROPHOTOGRAPHIC MEMBER, PROCESS CARTRIDGE AND ELECTROPHOTOGRAPHIC APPARATUS

BACKGROUND OF THE INVENTION

Field of the Invention

The present disclosure relates to an electrophotographic member to be used for an electrophotographic apparatus, a process cartridge and an electrophotographic apparatus.

Description of the Related Art

In an electrophotographic apparatus, electrophotographic members including an electro-conductive layer having an electric resistance value (hereinafter, referred to as a "resistance value") of, for example, $1\times10^5$ to $1\times10^9\Omega$ are used as electrophotographic members such as a development roller, a charging member, a toner supply roller, a cleaning blade and a development blade.

For adjusting a resistance value, an ionic electro-conductive agent excellent in uniformity of resistance is used.

Japanese Patent Application Laid-Open No. 2011-118113 discloses an electro-conductive roll which has a surface layer containing a urethane resin obtained by reacting an isocyanate with an ionic liquid having a cation structure having a hydroxyl group so that fogging in a low-humidity environment is suppressed. In addition, Japanese Patent Application Laid-Open No. H11-209633 discloses an electro-conductive roller in which a quaternary ammonia salt group is incorporated in a main chain of a urethane resin to improve resistance stability during continuous passage of current.

An outer surface of an electrophotographic member is roughened for improving the functions of the electrophotographic member. For example, a development member is an electrophotographic member which performs a function of carrying a toner on an outer surface thereof, and conveying the toner to a development region. Such an outer surface of an electrophotographic member is roughened so that the electrophotographic member can carry a larger amount of a toner.

One of methods for roughening the outer surface is a method in which a resin particle is incorporated in a layer forming the outer surface (hereinafter, also referred to as a "surface layer") of the electrophotographic member.

SUMMARY OF THE INVENTION

One aspect of the present disclosure is directed to providing an electrophotographic member capable of stably giving a high-quality electrophotographic image. Another aspect of the present disclosure is directed to providing an electrophotographic apparatus capable of stably outputting a high-quality electrophotographic image. Still another aspect of the present disclosure is directed to providing a process cartridge which contributes to stable formation of a high-quality electrophotographic image.

According to one aspect of the present disclosure, there is provided an electrophotographic member including: an electro-conductive substrate; and a resin layer as a surface layer on the substrate, wherein the resin layer contains a urethane resin having a structure of structural formula (1), an anion and a resin particle, the electrophotographic member has a protrusion derived from the resin particle on an outer surface thereof, the resin particle contains one or both of a urethane resin and a polyamide resin, the resin layer further contains carbon black, and the carbon black extracted from the resin layer has a BET specific surface area of 33 $m^2/g$ or more and 133 $m^2/g$ or less, and DBP absorption amount at a 70% torque value in DBP absorption measurement of 42 ml/100 g or more and 90 ml/100 g or less:

Structural formula (1)

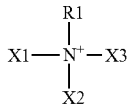

wherein in structural formula (1), R1 represents a hydrogen atom, or a monovalent hydrocarbon group having 1 or more and 12 or less carbon atoms, X1 to X3 each independently represent a structure of one selected from the group consisting of structural formulas (X101) to (X103), or a monovalent hydrocarbon group having 1 or more and 12 or less carbon atoms, and at least one of X1 to X3 is a structure of one selected from the group consisting of structural formulas (X101) to (X103):

(X101)

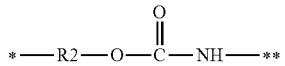

wherein in structural formula (X101), R2 represents a linear or branched divalent hydrocarbon group, a symbol "*" represents a point of attachment to a nitrogen atom in structural formula (1), and a symbol "**" represents a point of attachment to a carbon atom in a polymer chain forming the resin;

(X102)

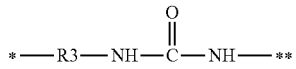

wherein in structural formula (X102), R3 represents a linear or branched divalent hydrocarbon group, a symbol "*" represents a point of attachment to a nitrogen atom in structural formula (1), and a symbol "**" represents a point of attachment to a carbon atom in a polymer chain forming the resin;

(X103)

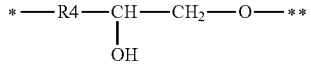

wherein in structural formula (X103), R4 represents a linear or branched divalent hydrocarbon group, a symbol "*" represents a point of attachment to a nitrogen atom in structural formula (1), and a symbol "**" represents a point of attachment to a carbon atom in a polymer chain forming the resin.

According to another aspect of the present disclosure, there is provided a process cartridge configured to be detachably attached to a main body of an electrophotographic apparatus, the process cartridge including at least one electrophotographic member selected from the group consisting of a charging member, a development member and a cleaning member, wherein the electrophotographic member is the above-described electrophotographic member.

According to still another aspect of the present disclosure, there is provided an electrophotographic image forming apparatus including an electrophotographic photosensitive member; a charging member disposed such that the electrophotographic photosensitive member can be charged; a development member; and a cleaning member, wherein at least one of the charging member, the development member and the cleaning member is the above-described electrophotographic member.

Further features of the present disclosure will become apparent from the following description of exemplary embodiments with reference to the attached drawings.

DESCRIPTION OF THE EMBODIMENTS

Figure 1A:
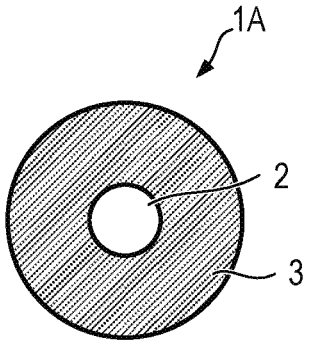
FIGS. 1A, 1B and 1C are schematic sectional views of an electrophotographic roller according to one embodiment of the present disclosure.

Preferred embodiments of the present disclosure will now be described in detail in accordance with the accompanying drawings.

For the electro-conductive roller according to Japanese Patent Application Laid-Open No. 2011-118113 and the electro-conductive roller according to Japanese Patent Application Laid-Open No. H11-209633, the present inventors incorporated a resin particle including a urethane resin or a polyamide resin in a urethane coating layer to prepare an electro-conductive roller having a roughened outer surface, and evaluated the performance of the electro-conductive roller as a development roller. The result showed that when the electro-conductive roller was applied as a development roller of a high-speed electrophotographic image forming apparatus, there were cases where the quality of an electrophotographic image was gradually deteriorated in formation of a large number of electrophotographic images.

The present inventors have conducted studies for revealing a cause of deteriorating the quality of an electrophotographic image when an electro-conductive roller with an outer surface roughened by incorporating a resin particle including a urethane resin or a polyamide resin in the urethane coating layer of each of the electro-conductive roller according to Japanese Patent Application Laid-Open No. 2011-118113 and the electro-conductive roller according to Japanese Patent Application Laid-Open No. H11-209633 is used as a development roller of a high-speed electrophotographic image forming apparatus.

As a result, the present inventors have found that the deterioration of image quality is caused by falling of a resin particle from a urethane coating layer.

Therefore, the present inventors have conducted studies with the aim of suppressing falling of a resin particle from a urethane coating layer. As a result, the present inventors have found that by coexistence of carbon black with a resin particle in a urethane coating layer, falling of the resin particle from the urethane coating layer can be effectively suppressed.

That is, an electrophotographic member according to one aspect of the present disclosure includes an electro-conductive substrate, and a resin layer as a surface layer on the substrate.

The resin layer contains a urethane resin having a structure of structural formula (1), an anion and a resin particle, the electrophotographic member has a protrusion derived from the resin particle on an outer surface thereof, and the resin particle contains one or both of a urethane resin and a polyamide resin.

Structural formula (1)

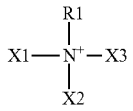

In structural formula (1), R1 represents a hydrogen atom, or a monovalent hydrocarbon group having 1 or more and 12 or less carbon atoms, X1 to X3 each independently represent a structure of one selected from the group consisting of structural formulas (X101) to (X103), or a monovalent hydrocarbon group having 1 or more and 12 or less carbon atoms, and at least one of X1 to X3 is a structure of one selected from the group consisting of structural formulas (X101) to (X103):

(X101)

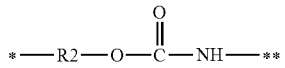

wherein in structural formula (X101), R2 represents a linear or branched divalent hydrocarbon group, a symbol "*" represents a point of attachment to a nitrogen atom in structural formula (1), and a symbol "**" represents a point of attachment to a carbon atom in a polymer chain forming the resin;

(X102)

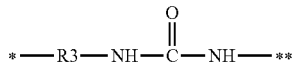

wherein in structural formula (X102), R3 represents a linear or branched divalent hydrocarbon group, a symbol "*" represents a point of attachment to a nitrogen atom in structural formula (1), and a symbol "**" represents a point of attachment to a carbon atom in a polymer chain forming the resin;

(X103)

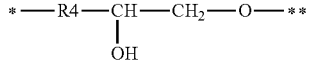

wherein in structural formula (X103), R4 represents a linear or branched divalent hydrocarbon group, a symbol "*" represents a point of attachment to a nitrogen atom in structural formula (1), and a symbol "**" represents a point of attachment to a carbon atom in a polymer chain forming the resin.

The resin layer further contains carbon black, and the carbon black extracted from the resin layer has a BET specific surface area of 33 $m^2/g$ or more and 133 $m^2/g$ or less, and DBP absorption amount at a 70% torque value in DBP absorption measurement of 42 ml/100 g or more and 90 ml/100 g or less.

The present inventors presume that the reason why with the electrophotographic member according to this aspect, a resin particle is unlikely to fall from a resin layer even when the electrophotographic member is used for a long period of time as a development member in a high-speed process is as follows.

Strong interaction between urethane groups or between a urethane group and an amide group normally acts on an interface between a urethane resin as a binder (hereinafter, referred to simply as a "binder") and a resin particle including a urethane resin or a polyamide resin (hereinafter, referred to as a resin particle). The interaction serves to contribute to suppression of falling of a resin particle.

However, studies by the present inventors show that when a binder has a quaternary ammonium cation structure in the molecule, a cation moiety chemically interacts with a urethane bond of the binder which is present around the cation moiety.

When the urethane bond of the binder interacts with the quaternary ammonium cation structure, the number of urethane bonds which can interact with the surface of a resin particle decreases. Therefore, it is presumed that when a binder has a cation structure such as quaternary ammonium in the molecule, a contained resin particle may easily fall.

Further, when a urethane resin having a quaternary ammonium cation structure coexists with carbon black in a resin layer containing a resin particle, falling of the resin particle is suppressed or falling of the resin particle is promoted according to the properties of carbon black.

Specifically, when carbon black having the following properties is used, falling of a resin particle is suppressed, and an image defect due to falling of the resin particle is remarkably suppressed.

The BET specific surface area is 33 $m^2/g$ or more and 133 $m^2/g$ or less.

The absorption at a 70% torque value in DBP absorption measurement is 42 ml/100 g or more and 90 ml/100 g or less.

Carbon black has a polar functional group including oxygen and hydrogen on a surface thereof except for carbon black subjected to special high-temperature treatment. Therefore, carbon black has the nature of adsorbing a portion having a high polarity in a resin.

The carbon black has a low physical adsorption capacity as a filler because the carbon black has a relatively small specific surface area, and small development of structures. Therefore, the carbon black is considered to easily interact with a quaternary ammonium cation moiety having a high polarity in a binder, but to be unlikely to interact with a urethane bond having a polarity lower than the polarity of the cation moiety.

On the other hand, a physical adsorption action between carbon black and the quaternary ammonium moiety reduces chemical interaction between the quaternary ammonium moiety and the urethane bond of the binder.

It is presumed that as a result, the number of urethane bonds which do not interact with either the carbon black or the quaternary ammonium moiety increases, and thus the binder can interact the surface of the resin particle, leading to suppression of falling of the resin particle.

(1) Electrophotographic Member

An electrophotographic member according to one embodiment of the present disclosure includes an electro-conductive substrate, and at least one electro-conductive resin layer on the substrate.

Figure 1B:
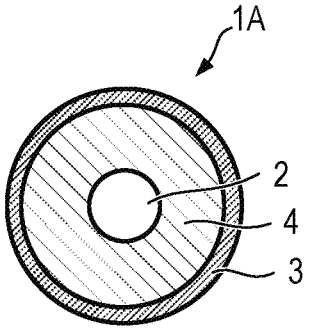
Figure 1C:
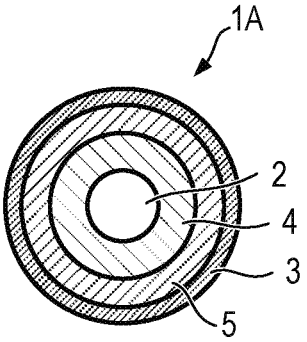

As one example of the electrophotographic member, a roller-shaped electrophotographic member (hereinafter, also referred to as an "electrophotographic roller") is illustrated in FIGS. 1A to 1C. An electrophotographic roller 1A illustrated in FIG. 1A includes an electro-conductive substrate 2, and an electro-conductive resin layer 3 provided on the outer periphery of the substrate 2. As illustrated in FIG. 1B, an elastic layer 4 may be further provided between the substrate 2 and the resin layer 3. In addition, As illustrated in FIG. 1C the electrophotographic roller 1A may have a three-layer structure in which an intermediate layer 5 is disposed between the elastic layer 4 and the resin layer 3, or the electrophotographic roller 1A may have a multilayer structure in which a plurality of intermediate layers 5 are disposed. For the electrophotographic roller 1A to more effectively exhibit an effect according to one embodiment of the present disclosure, the resin layer 3 is preferably present as an outermost layer of the electrophotographic roller 1A as illustrated in FIGS. 1A to 1C. In addition, the electrophotographic roller 1A preferably has the elastic layer 4.

The layer configuration of the electrophotographic roller 1A is not limited to a structure in which the resin layer 3 is present at the outermost layer of the electrophotographic roller 1A. Specific examples of the electrophotographic roller 1A include electrophotographic rollers further having a surface layer on the substrate 2 and the electro-conductive resin layer 3 provided on the periphery of the substrate 2, and electrophotographic rollers having the resin layer 3 as the intermediate layer 5.

Figure 2A:
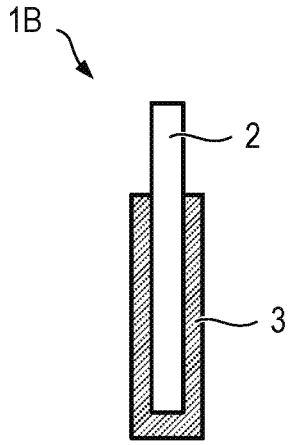
FIGS. 2A and 2B are schematic sectional views of an electrophotographic blade according to one embodiment of the present disclosure.
Figure 2B:
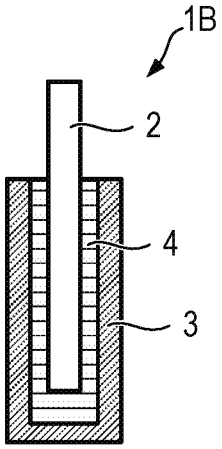

In addition, other examples of the electrophotographic member include blade-shaped electrophotographic members (electrophotographic blades). FIGS. 2A and 2B are schematic sectional views of an electrophotographic blade 1B. The electrophotographic blade 1B shown in FIG. 2A includes the electro-conductive substrate 2, and the electro-conductive resin layer 3 provided on the outer periphery of the substrate 2. In the electrophotographic blade 1B shown in FIG. 2B, the elastic layer 4 is further provided between substrate 2 and the resin layer 3.

The electrophotographic member can be used for a development roller, a charging member, a toner supply roller, a development blade and a cleaning blade. Hereinafter, the configuration of the electrophotographic member according to one embodiment of the present disclosure will be described in detail.

<Substrate>

The substrate 2 serves as a support member for the electrophotographic member, and optionally as an electrode. The substrate 2 is formed of an electro-conductive material such as a metal or alloy such as aluminum, a copper alloy or stainless steel; iron plated with chromium or nickel; or a synthetic resin having electrical conductivity. When the electrophotographic member has a roller shape, the substrate 2 has a solid-cylindrical shape or a hollow-cylindrical shape, and when the electrophotographic member has a blade shape, the substrate 2 has a thin-plate shape.

<Elastic Layer>

Particularly when the electrophotographic member has a roller shape (electrophotographic roller 1A), the elastic layer 4 gives the electrophotographic roller 1A elasticity necessary for forming a nip having a predetermined width at a contact part between the electrophotographic roller 1A and a photosensitive member. The elastic layer 4 is preferably a molded product of a rubber material. Examples of the rubber material include: ethylene-propylene-diene copolymer rubber, acrylonitrile-butadiene rubber, chloroprene rubber, natural rubber, isoprene rubber, styrene-butadiene rubber, fluororubber, silicone rubber, epichlorohydrin rubber and urethane rubber. One of these materials can be used singly, or two or more of these materials can be used in combination. Among these materials, silicone rubber is preferable from the viewpoint of permanent compression set and flexibility. Examples of the silicone rubber include cured products of addition-curable silicone rubber.

Examples of the method for molding the elastic layer 4 include methods including subjecting a liquid rubber material to die molding, and methods including subjecting a kneaded rubber material to extrusion-molding. The thickness of the elastic layer is preferably 0.3 mm or more and 4.0 mm or less.

An electrical conductivity imparting agent is appropriately blended in the elastic layer 4 for imparting electrical conductivity. As the electrical conductivity imparting agent, a fine particle of carbon black; an electro-conductive metal such as aluminum or copper; or an electro-conductive metal oxide such as tin oxide or titanium oxide can be used. Among these materials, carbon black is preferable because carbon black can be relatively easily acquired, and favorable electrical conductivity is obtained. When carbon black is used as an electrical conductivity imparting agent, carbon black is preferably blended in an amount of 2 to 50 parts by mass based on 100 parts by mass of rubber.

Various additives such as a non-electro-conductive filling agent, a crosslinking agent and a catalyst may be appropriately blended in the elastic layer 4. Examples of the non-electro-conductive filling agent include silica, quartz powder, titanium oxide and calcium carbonate. Examples of the crosslinking agent include di-t-butyl peroxide, 2,5-dimethyl-2,5-di(t-butyl peroxide)hexane and dicumyl peroxide. Examples of the catalyst include platinum catalysts.

<Resin Layer>

The configuration of the resin layer 3 will be described in detail. The resin layer according to one embodiment of the present disclosure contains a urethane resin as a binder having a quaternary ammonium cation structure of structural formula (1), an anion as a counter ion to the cation structure, a resin particle containing at least one of a urethane resin and a polyamide resin, and carbon black having a specific property.

(Cation Structure of Structural Formula (1))

Structural formula (1)

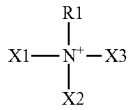

In structural formula (1), R1 represents a hydrogen atom, or a monovalent hydrocarbon group having 1 or more and 12 or less carbon atoms, X1 to X3 each independently represent a structure of one selected from the group consisting of structural formulas (X101) to (X103), or a monovalent hydrocarbon group having 1 or more and 12 or less carbon atoms, and at least one of X1 to X3 is a structure of one selected from the group consisting of structural formulas (X101) to (X103). Specifically, the structural formula (1) represents a quaternary ammonium cation moiety having a point of attachment to a resin.

(Necessity of Immobilization)

The urethane resin having a structure of structural formula (1) is a urethane resin having a quaternary ammonium group in the structure.

According to studies by the present inventors, at least half the number of quaternary ammonium groups contained in the urethane resin preferably have a chemical bond with the urethane resin, and almost all the quaternary ammonium groups more preferably have a chemical bond with the urethane resin.

When the quaternary ammonium group does not have a chemical bond with the urethane resin, e.g., only a salt of trimethylbutylammonium (a so-called ammonium-based ionic electro-conductive agent) is used, it may be impossible to obtain the effect of the present disclosure. It is presumed that when the quaternary ammonium group does not have a chemical bond with the urethane resin, the quaternary ammonium salt behaves like a surfactant, is oriented at an interface between the binder and the resin particle, and thus causes falling of the resin particle.

The urethane resin having a structure of structural formula (1) is obtained by, for example, reacting the following:

- ionic compound having at least one hydroxyl group, amino group and glycidyl group in a quaternary ammonium cation structure;
- polyisocyanate; and
- polymer polyol which does not have a structure of structural formula (1).

In structural formula (1), structural formula (X101) represents a residue formed by, for example, reaction of a hydroxyl group introduced into a cation and an isocyanate group of a matrix resin. Structural formula (X103) represents a residue formed by, for example, reaction of an amino group introduced into a cation and an isocyanate group of a matrix resin. Structural formula (X102) represents a residue formed by, for example, reaction of an amino group introduced into a cation and an isocyanate group of a matrix resin. Structural formula (X103) represents a residue formed by, for example, reaction of a glycidyl group introduced into a cation and a hydroxyl group of a matrix resin.

(X101)

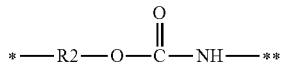

wherein in structural formula (X101), R2 represents a linear or branched divalent hydrocarbon group, a symbol "*" represents a point of attachment to a nitrogen atom in structural formula (1), and a symbol "**" represents a point of attachment to a carbon atom in a polymer chain forming the resin;

(X102)

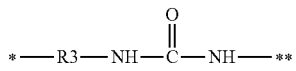

wherein in structural formula (X102), R3 represents a linear or branched divalent hydrocarbon group, a symbol "*" represents a point of attachment to a nitrogen atom in structural formula (1), and a symbol "**" represents a point of attachment to a carbon atom in a polymer chain forming the resin; and

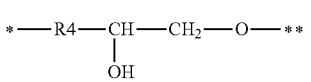

(X103)

wherein in structural formula (X103), R4 represents a linear or branched divalent hydrocarbon group, a symbol "*" represents a point of attachment to a nitrogen atom in structural formula (1), and a symbol "**" represents a point of attachment to a carbon atom in a polymer chain forming the resin.

Specific examples of the cation giving a structure represented by structural formula (1) and having a hydroxyl group include a 2-hydroxyethyltrimethylammonium cation, a 2-hydroxyethyltriethylammonium cation, a 4-hydroxybutyltrimethylammonium cation, a 4-hydroxybutyl-tri-n-butylammonium cation, a 8-hydroxyoctyltrimethylammonium cation and a 8-hydroxyoctyl-tri-n-butylammonium cation;

a bis(hydroxymethyl)dimethylammonium cation, a bis(2-hydroxyethyl)dimethylammonium cation, a bis(3-hydroxypropyl)dimethylammonium cation, a bis(4-hydroxybutyl)dimethylammonium cation, a bis(8-hydroxyoctyl)dimethyl ammonium cation and a bis(8-hydroxyoctyl)-di-n-butylammonium cation;

a tris(hydroxymethyl)methylammonium cation, a tris(2-hydroxyethyl)methylammonium cation, a tris(3-hydroxypropyl)methylammonium cation, a tris(4-hydroxybutyl)methylammonium cation and a tris(8-hydroxyoctyl)methyl ammonium cation; and derivatives thereof.

Examples of the ammonium cation having an amino group or a glycidyl group include cations in which a hydroxyl group in the cation is replaced by an amino group or a glycidyl group.

The state after the reactions can be checked by performing analysis with a known unit by pyrolytic GC/MS, FT-IR, NMR or the like.

(Anion)

The resin layer contains an anion together with a cation structure of structural formula (1).

Examples of the anion include fluoroalkylsulfonylimide anions, fluorosulfonylimide anions, fluoroalkyl sulfonate anions, fluorosulfonate anions, fluoroalkylcarboxylate anions, fluoroalkylmethide anions, fluoroborate anions, fluorophosphate anions, dicyanamide anions, thiocyanate anions, bis-oxalatoborate anions, perchlorate anions and derivatives thereof.

Specific examples of the fluoroalkylsulfonylimide anion include fluoroalkylsulfonylimide anions having a fluoroalkyl group having 1 or more and 6 or less carbon atoms, such as a bis(trifluoromethanesulfonyl)imide anion, a bis(pentafuoroethanesulfonyl)imide anion, a bis(heptafluoropropanesulfonyl)imide anion, a bis(nonafluorobutanesulfonyl)imide anion, a bis(dodecafluoropentanesulfonyl)imide anion and a bis(perfluorohexanesulfonyl)imide anion; and cyclic fluoroalkylsulfonylimide anions such as N,N-hexafluoropropane-1,3-disulfonylimide.

Specific examples of the fluorosulfonylimide anion include a bis(fluorosulfonyl)imide anion.

Specific examples of the fluoroalkylsulfonate anion include a trifluoromethanesulfonate anion, a fluoromethanesulfonate anion, a perfluoroethanesulfonate anion, a perfluoropropanesulfonate anion, a perfluorobutanesulfonate anion, a perfluoropentanesulfonate anion, a perfluorohexanesulfonate anion and a perfluorooctanesulfonate anion.

Specific examples of the fluoroalkylcarboxylate anion include a trifluoroacetate anion, a perfluoropropionate anion, a perfluorobutyrate anion, a perfluorovalerate anion and a perfluorocaprate anion.

Specific examples of the fluoroalkylmethide anion include fluorinated alkylsulfonylmethide anions such as a tris(trifluoromethanesulfonyl)methide anion, a tris(perfluoroethanesulfonyl)methide anion, a tris(perfluoropropanesulfonyl)methide anion, a tris(perfluorobutanesulfonyl)methide anion, a tris(perfluoropentanesulfonyl)methide anion, a tris(perfluorohexanesulfonyl)methide anion and a tris(perfluorooctanesulfonyl)methide anion.

Specific examples of the fluoroborate anion include a tetrafluoroborate anion.

Specific examples of the fluorophosphate anion include a hexafluorophosphate anion.

Among these anions, fluoroalkylsulfonylimide anions, fluorosulfonylimide anions, fluoroborate anions, dicyanamide anions and thiocyanate anions are especially preferable because the anions suffer from less reduction of electrical conductivity in a low-temperature environment.

(Urethane Resin)

The urethane resin may have a structure other than a structure represented by structural formula (1).

Such a urethane resin is more preferably a urethane resin obtained by, for example, reacting an ionic compound having at least one hydroxyl group, amino group and glycidyl group in a quaternary ammonium cation structure, a polyisocyanate and a polymer polyol at a time.

Examples of the polymer polyol include polyether polyols, polyester polyols or polycarbonate polyols, polyolefin polyols and acryl polyols. Among them, polyether polyols, polyester polyols or polycarbonate polyols, and urethane prepolymer polyols obtained by reacting such a polyol with an isocyanate are preferable from the viewpoint of a self-film-reinforcing property and compatibility with an ionic compound.

Examples of the polyether polyol include polyethylene glycol, polypropylene glycol and polytetramethylene glycol.

In addition, examples of the polyester polyol include the following: polyester polyols obtained by condensation reaction of a diol component such as 1,4-butanediol, 3-methyl-1,4-pentanediol or neopentyl glycol or a triol component such as trimethylolpropane with a dicarboxylic acid such as adipic acid, phthalic anhydride, terephthalic acid or hexahydroxyphthalic acid.

In addition, examples of the polycarbonate polyol include the following: polycarbonate polyols obtained by condensation reaction of a diol component such as 1,3-propanediol, 1,4-butanediol, 1,6-hexanediol, 3-methyl-1,6-pentanediol, diethylene glycol, polyethylene glycol, polypropylene glycol or polytetramethylene glycol with a dialkyl carbonate such as phosgene or dimethyl carbonate or a cyclic carbonate such as ethylene carbonate.

The glass transition temperature of the urethane resin is especially preferably −10° C. or lower because falling of a resin particle is further suppressed. When the glass transition temperature of the urethane resin is −10° C. or lower, components of the binder are unlikely to be crystallized, and thus the molecular mobility of the urethane bond is unlikely to be reduced in a practical service temperature range of an electrophotographic apparatus. Therefore, it is presumed that the urethane bond of the binder is more easily oriented to the surface of the resin particle.

When a urethane resin is used, it is preferable to use a polyol having a branched ether structure represented by one of structural formulas (2) to (5) below, or a branched ester structure represented by structural formula (6) below because the crystallinity of the urethane resin is reduced. That is, the urethane resin preferably contains a reaction product of an isocyanate compound and a polyol having a structure of one selected from the group consisting of following structural formulas (2) to (6) together with an ammonium ion compound having a reactive functional group.

Structural formula (2)

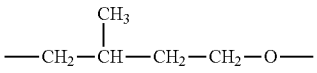

Stuctural formula (3)

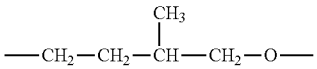

Structural formula (4)

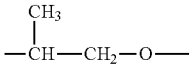

Structural formula (5)

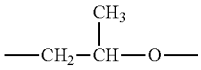

Structural formula (6)

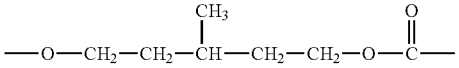

The structures represented by structural formulas (2) and (3) are obtained by using a polyether polyol obtained by, for example, subjecting 3-methyltetrahydrofuran to ring-opening polymerization.

The structures represented by structural formulas (4) and (5) are obtained by using a polyether polyol obtained by, for example, subjecting propylene oxide to ring-opening polymerization.

The structure represented by structural formula (6) is obtained by using a polyester polyol obtained by, for example, condensation reaction of 3-methyl-1,5-pentanediol with a dicarboxylic acid such as adipic acid. Alternatively, the structure represented by structural formula (6) is obtained by using 3-methyl-1,5-pentanediol and a dialkyl carbonate such as phosgene or dimethyl carbonate.

These polyol components may be, if necessary, prepolymers subjected to chain extension with an isocyanate compound such as 2,4-tolylene diisocyanate (TDI), 4,4'-diphenylmethane diisocyanate (MDI) or isophorone diisocyanate in advance.

The isocyanate compound is not particularly limited, and aliphatic polyisocyanates such as ethylene diisocyanate and 1,6-hexamethylene diisocyanate (HDI); cycloaliphatic polyisocyanates such as isophorone diisocyanate (IPDI), cyclohexane 1,3-diisocyanate and cyclohexane 1,4-diisocyanate; aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate and naphthalene diisocyanate; and copolymers, isocyanurate forms, TMP adduct forms and biuret forms thereof, and block forms thereof can be used. Among these, aromatic isocyanates such as tolylene diisocyanate, diphenylmethane diisocyanate and polymeric diphenylmethane diisocyanate are preferable.

Preferably, a polyol component and an isocyanate compound are mixed such that the ratio (molar ratio) of isocyanate groups in the isocyanate compound to hydroxyl groups in the polyol component is 1.0 or more and 2.0 or less. When the mixing ratio is within the above-described range, remaining of unreacted components can be suppressed.

In the present disclosure, the resin layer may contain a resin other than a urethane resin having a structure represented by structural formula (I).

Examples of the resin that may be contained in the resin layer include polyurethane resins having no structure of structural formula (1), polyester resins, polyether resins, acrylic resins, epoxy resins, amino resins such as melamine resins, and copolymers thereof. Polyurethane resins and melamine crosslinked resins are preferable from the viewpoint of film strength and toner chageability. In particular, thermosetting polyether polyurethane resins and thermosetting polyester polyurethane resins are suitably used because these resins also have flexibility. These thermosetting polyurethane resins are obtained by reaction of an isocyanate compound with a known polyol component such as a polyether polyol or a polyester polyol.

(Carbon Black)

The resin layer contains carbon black, and the carbon black extracted from the resin layer has a BET specific surface area of 33 $m^2/g$ or more and 133 $m^2/g$ or less, and DBP absorption amount at a 70% torque value in DBP absorption measurement of 42 ml/100 g or more and 90 ml/100 g or less.

As described above, carbon black having the above-described property has a low adsorption ability as a filler, and therefore easily interacts with a quaternary ammonium group, but is unlikely to interact with a urethane group. Therefore, many of urethane groups contained in a binder can interact with the surface of a resin particle and thus falling of the resin particle can be suppressed.

Carbon black having a property which does not fall within the above-described property range, e.g., carbon black having a large BET specific surface area and a large DBP absorption, has a high adsorption capacity as a filler because the carbon black has a large specific surface area and a developed structure. Therefore, in addition to a quaternary ammonium moiety in the binder, a urethane bond of a urethane resin is adsorbed, and therefore the number of urethane bonds which can interact with the surface of the resin particle may slightly decrease.

In addition, carbon black which conversely has a very small BET specific surface area and a very small DBP absorption tends to have a reduced reinforcing effect as a filler. Therefore, the strength of a matrix phase (urethane resin in which carbon black is dispersed) covering the resin particle tends to be reduced. Therefore, the content of carbon black having a property which does not fall within the above-described property range is preferably low.

More preferably, the BET specific surface area of carbon black is 50 $m^2/g$ or more and 90 $m^2/g$ or less, and further, the DBP absorption amount at a 70% torque value in DBP absorption measurement is 70 ml/100 g or more and 80 ml/100 g or less because the carbon black is unlikely to adsorb a urethane group and is excellent in balance with a reinforcement property.

In addition, for obtaining the effect of the present disclosure at a higher level, it is especially preferable to use only carbon black having a BET specific surface area of 33 $m^2/g$ or more and 133 $m^2/g$ or less and DBP absorption amount of 42 ml/100 g or more and 90 ml/100 g or less at a 70% torque value in DBP absorption measurement.

Further, for the carbon black, [DBP absorption amount at maximum torque]−[DBP absorption amount at 30% torque] in DBP absorption measurement is more preferably 40 ml/100 g or less.

[DBP absorption amount at maximum torque]−[DBP absorption amount at 30% torque] in DBP absorption measurement indicates the magnitude of a variation in development of structures of carbon black aggregates.

Carbon black satisfying the above-described property is carbon black having a small variation in development of structures of carbon black aggregates. Therefore, most of contained aggregates are unlikely to adsorb urethane groups, and have a property in a range which provides excellent balance with a reinforcement property, and thus a particularly remarkable effect is exhibited in suppression of falling of a resin particle.

Specifically, by using only carbon black having DBP absorption amount of 42 ml/100 g or more and 90 ml/100 g or less at a 70% torque value in DBP absorption measurement, [DBP absorption amount at maximum torque]−[DBP absorption amount at 30% torque] in DBP absorption measurement can be set to 40 ml/100 g or less. That is, for exhibiting the effect of the present disclosure, it is more preferable to use single carbon black rather than mixing a plurality of specific different carbon blacks.

(pH of Carbon Black)

The pH of the carbon black is especially preferably 4.5 or less because falling of a resin particle is further suppressed. When the pH of carbon black is 4.5 or less, acid-base interaction between carbon black and a quaternary ammonium group represented by structural formula (1) reduces interaction between the quaternary ammonium group and a urethane bond of a binder. Therefore, it is presumed that interaction between the urethane bond of the binder and the surface of a resin particle is enhanced so that falling of the resin particle is further suppressed.

(Resin Particle)

The electrophotographic member has a protrusion derived from a resin particle on an outer surface thereof, and the resin particle contains one or both of a urethane resin and a polyamide resin. The urethane resin and the polyamide resin contained in the resin particle may contain polyether, polyester, polycarbonate, a polyolefin or an acrylic resin in a molecular structure. In addition, the resin particle may have reactive functional groups such as hydroxyl groups and isocyanate groups on a surface thereof.

For the resin particle, a crosslinked resin or a thermosetting resin can be used. A crosslinked resin is more preferable from the viewpoint of the strength of a surface protrusion.

The glass transition temperature of each of the urethane resin particle and the polyamide resin particle is preferably −10° C. or lower, more preferably −30° C. or lower because falling of the resin particle can be further suppressed. It is presumed that when the glass transition temperature of the resin particle is −10° C. or lower, the molecular mobility of the resin particle surface is unlikely to be suppressed even at a low temperature and thus the surface of resin particle easily interacts with a urethane bond of a binder.

The volume average particle diameter of the resin particle containing one or both of a urethane resin and a polyamide resin is preferably 1 μm or more and 20 μm or less. In addition, the content of the resin particle is preferably 5 parts by mass or more and 60 parts by mass or less based on 100 parts by mass of a urethane resin forming a resin layer.

A fine particle for forming a surface protrusion may include a fine particle other than a particle of a urethane resin or a polyamide resin as long as the effect of the present disclosure is not impaired. As the fine particle other than a particle of a urethane resin or a polyamide resin, a fine particle of a polyester resin, a polyether resin, an acrylic resin or a phenol resin can be used. The content of the fine particle other than a particle of a urethane resin or a polyamide resin is preferably 10 parts by mass or less based on 100 parts by mass of a resin forming the resin layer.

(Amount Ratio of Ion and Carbon Black) (Amount Ratio of Resin Particle and Carbon Black)

When Z1 is an ionic equivalent (eq) of a resin of structural formula (1) contained in 1 part by mass of the resin layer, Z2 is a content (parts by mass) of the carbon black contained in 100 parts by mass of the resin layer, Z3 is a percentage (%) of the cross-sectional area of the resin particle in the cross-sectional area of the resin layer, and Z4 is d90 (μm) in a cumulative distribution of the area-equivalent diameter of the resin particle in the cross-sectional area of the resin layer, it is especially preferable that Z2/Z1 be 1468 or more and 20175 or less and that Z3/(Z2·Z4) be 0.056 or more and 0.813 or less, because the effect of suppressing falling of a resin particle is sustained over a long period of time.

It is presumed that when Z2/Z1 is 1468 or more and 20175 or less, the resin layer has a proper content of carbon black with respect to the amount of quaternary ammonium groups contained in the urethane resin having a structure of structural formula (1), and therefore the number of urethane bonds adsorbed to the quaternary ammonium groups and carbon black can be further reduced so that the number of urethane bonds to interact with the resin particle increases.

Further, when Z3/(Z2·Z4) is 0.056 or more and 0.813 or less, the amount of carbon black is in a proper range with respect to the surface area of the resin particle so that a sufficient amount of urethane bonds capable of interacting with the surface of the resin particle is supplied with respect to the surface area of the resin particle. Therefore, it is presumed that the effect of suppressing falling of the resin particle is sustained over a long period of time.

(Method for Forming Resin Layer)

The method for forming a resin layer is not particular limited, and examples thereof include spray coating, dip coating and roll coating methods. Among these methods, a dip coating method including causing a coating material to overflow from the upper end of a dipping tank as described in Japanese Patent Application Laid-Open No. S57-5047 is preferably used because this method is convenient and excellent in production stability as a method for forming a resin layer. The thickness of the resin layer is preferably 1.0 μm or more and 20.0 μm or less.

(Other Components in Resin Layer)

The resin layer may contain non-electro-conductive filling agents such as silica, quartz powder, titanium oxide, zinc oxide and calcium carbonate as necessary. When added to a coating material for formation of a resin layer, these non-electro-conductive filling agents performs a function as a film formation aid in application of the coating material in a process for forming a resin layer. The content of the non-electro-conductive filling agents is preferably 10 parts by mass or more and 30 parts by mass or less based on 100 parts by mass of a resin forming the resin layer.

In addition, the resin layer may contain an electro-conductive filling agent as necessary as long as the effect of the present disclosure is not hindered. As the electro-conductive filling agent, a fine particle of an electro-conductive metal such as aluminum or copper; or an electro-conductive metal oxide such as zinc oxide, tin oxide or titanium oxide can be used.

(2) Electrophotographic Image Forming Apparatus

An electrophotographic image forming apparatus according to one aspect of the present disclosure is an electrophotographic image forming apparatus including an electrophotographic photosensitive member; a charging member disposed such that the electrophotographic photosensitive member can be charged; a development member; and a cleaning member, wherein at least one of the charging member, the development member and the cleaning member is the above-described electrophotographic member.

Specifically, the electrophotographic member can be suitably used as a development roller, a charging roller, a toner supply roller, a development blade or a cleaning blade. The electrophotographic member can be applied to all of non-contact-type development apparatuses and contact-type development apparatuses using a magnetic one-component toner and a nonmagnetic one-component toner, and development apparatuses using a two-component toner.

Figure 3:
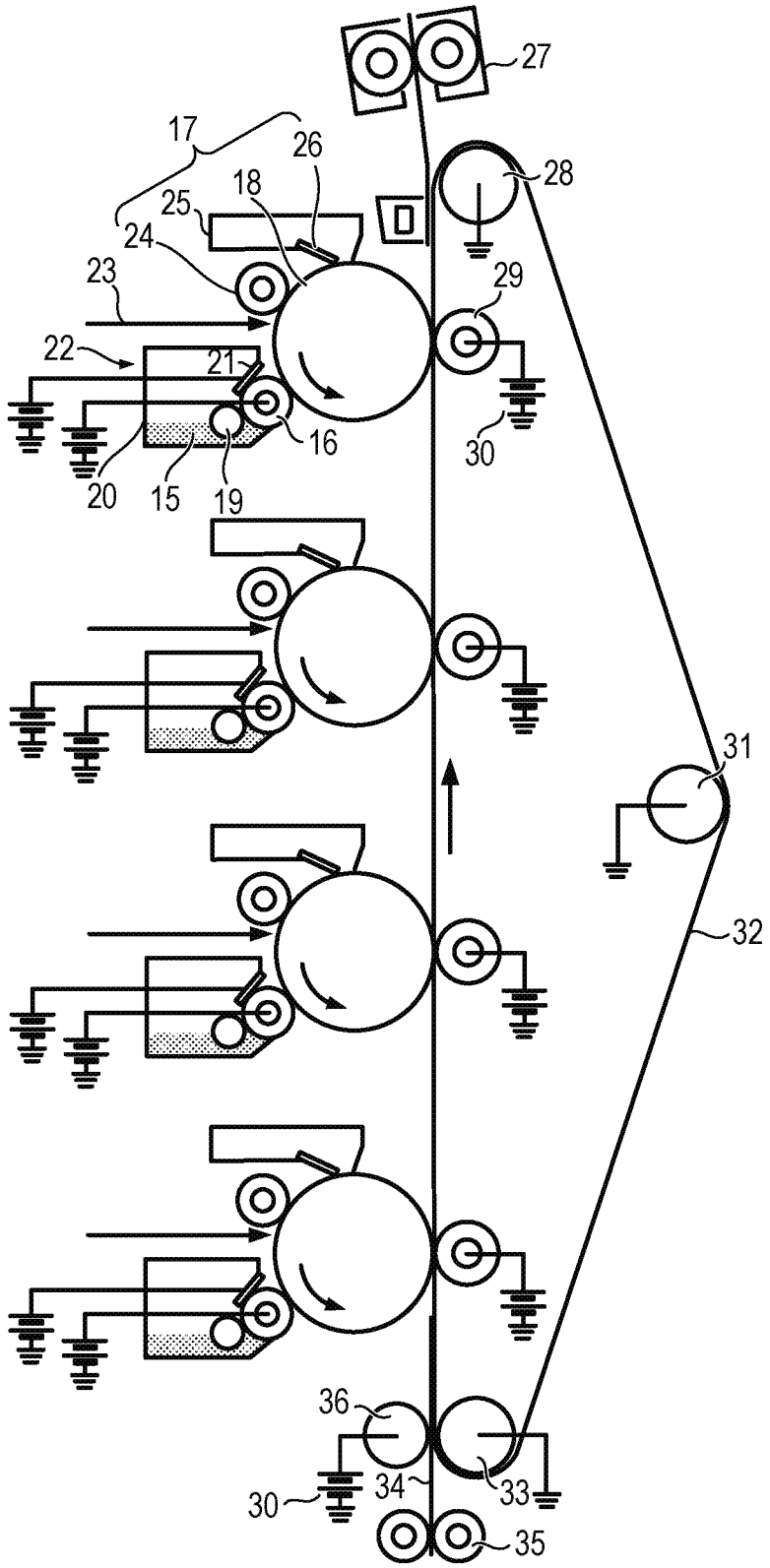
FIG. 3 is a schematic sectional view of an electrophotographic apparatus according to one embodiment of the present disclosure.

FIG. 3 is a schematic sectional view illustrating one example of an electrophotographic apparatus in which the electrophotographic member according to one aspect of the present disclosure is mounted as a development roller of a contact-type development apparatus using a one-component toner. A development apparatus 22 includes a toner container 20 containing a toner 15 as a one-component toner; a development roller 16; a toner supply roller 19 for supplying the toner to the development roller 16; and a development blade 21 for regulating the thickness of a toner layer on the development roller 16. The development roller 16 is positioned at an opening section extending in a longitudinal direction in the toner container 20, and installed in contact with a photosensitive member 18. The photosensitive member 18, a cleaning blade 26, a waste toner storing container 25 and a charging roller 24 may be disposed in an electrophotographic apparatus main body. The development apparatus 22 is provided for toners of colors of Black (Bk), Cyan (C), Magenta (M) and Yellow (Y) to enable color printing.

Hereinafter, a printing operation of the electrophotographic apparatus will be described. The photosensitive member 18 is rotated in an arrow direction, and uniformly charged by the charging roller 24 for charging the photosensitive member 18. An electrostatic latent image is then formed on a surface of the photosensitive member 18 by laser light 23 as an exposure unit. The electrostatic latent image is made visible as a toner image (developed) when the development apparatus 22 gives the toner 15 to the photosensitive member 18 from the development roller 16 disposed in contact with the photosensitive member 18. The development is so-called reversal development in which a toner image is formed on an exposed section. The toner image formed on the photosensitive member 18 is transferred to a sheet 34 as a recording medium by a transfer roller 29 as a transfer member. The sheet 34 is fed into the apparatus via a sheet feeding roller 35 and an adsorption roller 36, and conveyed between the photosensitive member 18 and the transfer roller 29 by an endless belt-shaped transfer and conveyance belt 32. The transfer and conveyance belt 32 operates with a driven roller 33, a driving roller 28 and a tension roller 31. A voltage is applied to the development roller 16, the development blade 21 and the adsorption roller 36 from a bias power supply 30. The sheet 34 to which the toner image is transferred is subjected to fixation treatment by a fixation apparatus 27, and discharged outside the apparatus to end the printing operation. On the other hand, a toner left after transfer, which remains on the photosensitive member 18 without being transferred, is scraped up by the cleaning blade 26 as a cleaning member for cleaning the surface of the photosensitive member, and put in the waste toner storing container 25. The cleaned photosensitive member 18 repeatedly performs the printing operation.

(3) Process Cartridge

A process cartridge according to one aspect of the present disclosure is configured to be detachably attached to a main body of an electrophotographic apparatus. The process cartridge includes at least one electrophotographic member selected from the group consisting of a charging member, a development member and a cleaning member, and the electrophotographic member is the above-described electrophotographic member.

Figure 4:
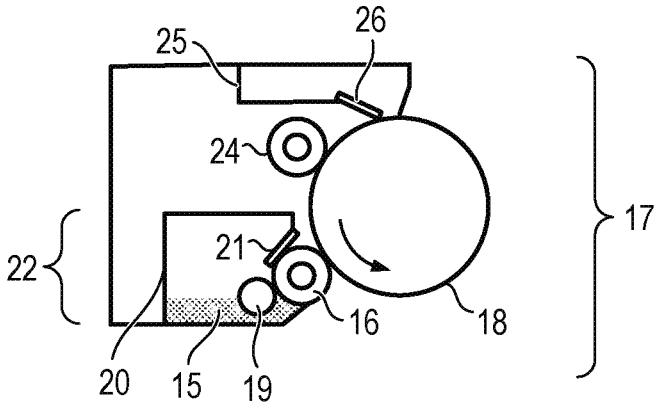
FIG. 4 is a schematic sectional view of a process cartridge according to one embodiment of the present disclosure.

Specifically, the electrophotographic member according one aspect of the present disclosure can be suitably used as a development roller, a charging roller, a toner supply roller, a development blade or a cleaning blade in a process cartridge. FIG. 4 is a schematic sectional view of one example of a process cartridge according to one aspect of the present disclosure. In FIG. 4, the electrophotographic member is mounted as the development roller 16. A process cartridge 17 is configured to be detachably attached to an electrophotographic apparatus. The process cartridge 17 is formed by integrating the development apparatus 22 including the development roller 16 and the development blade 21, the photosensitive member 18, the cleaning blade 26, the waste toner storing container 25 and the charging roller 24. The development apparatus 22 further includes the toner container 20, and the toner 15 is packed in the toner container 20. The toner 15 in the toner container 20 is supplied to the surface of the development roller 16 by the toner supply roller 19, and a layer of the toner 15 with a predetermined thickness is formed on the surface of the development roller 16.

According to one aspect of the present disclosure, an electrophotographic member capable of maintaining high image quality and high durability even in a high-speed and a long-lifetime electrophotographic process is obtained. According to another aspect of the present disclosure, an electrophotographic apparatus capable of stably outputting a high-quality electrophotographic image is obtained. According to still another aspect of the present disclosure, a process cartridge capable of stably forming a high-quality electrophotographic image.

EXAMPLES

Examples and Comparative Examples will be shown below. First, a raw material for a urethane resin having a structure represented by structural formula (1) was synthesized.

<Synthesis of Ionic Compound>

(Synthesis of Ionic Compound IC-1)

30.0 g of a 50% tris(2-hydroxyethyl)methylammonium hydroxide aqueous solution (manufactured by Tokyo Chemical Industry Co., Ltd.) was dissolved in 50.0 g of ion-exchange water. Next, a solution obtained by dissolving 12.9 g of lithium trifluoromethanesulfonate (trade name: EF-15 manufactured by Mitsubishi Materials Electronic Chemicals Co., Ltd.) as an anion raw material in 30 g of ion-exchange water was dropped over 30 minutes, and the resulting mixture was stirred at 30° C. for 6 hours. Next, the reaction solution was extracted twice using 100.0 g of ethyl acetate. Next, the separated ethyl acetate layer was washed three times using 80 g of ion-exchange water. Subsequently, ethyl acetate was distilled off under reduced pressure to obtain an ionic compound IC-1 represented by the following formula.

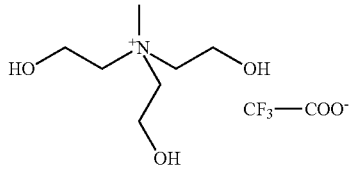

(Synthesis of Ionic Compound IC-2)

15.0 g of choline chloride (manufactured by Tokyo Chemical Industry Co., Ltd.) was dissolved in 100 ml of pure water, 23.5 g of potassium N,N-bis(fluorosulfonyl) imide (tradename: K-FSI manufactured by Mitsubishi Materials Electronic Chemicals Co., Ltd.) was added as an anion raw material, and the resulting mixture was stirred at room temperature. 100 ml of ethyl acetate was added to the reaction solution, and the organic layer was washed three times using 80 g of ion-exchange water. Next, ethyl acetate was distilled off under reduced pressure to obtain an ionic compound IC-2 represented by the following formula.

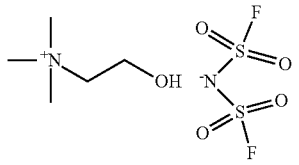

(Synthesis of Ionic Compound IC-3)

15.0 g of diethylenetriamine (manufactured by Tokyo Chemical Industry Co., Ltd.) was dissolved in 35.0 g of tetrahydrofuran. Next, the reaction system was brought in a nitrogen atmosphere, and cooled with ice. Subsequently, a solution obtained by dissolving 45.5 g of methyl iodide (manufactured by Tokyo Chemical Industry Co., Ltd.) in 80.0 g of tetrahydrofuran was dropped over 30 minutes. The reaction solution was heated and refluxed for 12 hours, 100 ml of water was then added, and the solvent was distilled off under reduced pressure. 100 ml of ethanol was added to the residue, the resulting mixture was stirred at room temperature, the insoluble matter was removed by filtration over celite, and the solvent was then distilled off under reduced pressure again.

The obtained product was dissolved in 160 ml of pure water, 13.0 g of sodium dicyanamide (manufactured by Tokyo Chemical Industry Co., Ltd.) was added as an anion raw material, and the resulting mixture was stirred at room temperature for 1 hour. Next, the reaction solution was extracted twice using 100.0 g of ethyl acetate. Next, the separated ethyl acetate layer was washed three times using 60 g of ion-exchange water. Subsequently, ethyl acetate was distilled off under reduced pressure to obtain an ionic compound IC-3 represented by the following formula.

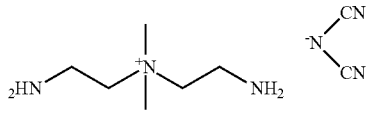

(Synthesis of Ionic Compound IC-4)

15.0 g of glycidyltrimethylammonium chloride (about 80% aqueous solution) (manufactured by Tokyo Chemical Industry Co., Ltd.) was dissolved in 40.0 g of ion-exchange water. Next, a solution obtained by dissolving 8.2 g of sodium thiocyanate (manufactured by Wako Pure Chemical Industries Co., Ltd.) as an anion raw material in 60 g of ion-exchange water was dropped over 30 minutes, and the resulting mixture was stirred at 30° C. for 2 hours. Next, the reaction solution was extracted twice using 100.0 g of ethyl acetate. Next, the ethyl acetate layer obtained by performing separation was washed three times using 60 g of ion-exchange water. Subsequently, ethyl acetate was distilled off under reduced pressure to obtain an ionic compound IC-4 represented by the following formula.

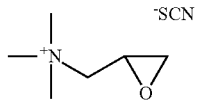

(Synthesis of Ionic Compound IC-5)

15.0 g of bis(2-hydroxyethyl)dimethylammonium chloride (manufactured by Tokyo Chemical Industry Co., Ltd.) was dissolved in 40.0 g of ion-exchange water. Next, a solution obtained by dissolving 25.4 g of lithium trifluoromethanesulfonate (trade name: EF-15 manufactured by Mitsubishi Materials Electronic Chemicals Co., Ltd.) as an anion raw material in 60 g of ion-exchange water was dropped over 30 minutes, and the resulting mixture was stirred at 30° C. for 2 hours. Next, the reaction solution was extracted twice using 100.0 g of ethyl acetate. Next, the ethyl acetate layer obtained by performing separation was washed three times using 60 g of ion-exchange water. Subsequently, ethyl acetate was distilled off under reduced pressure to obtain an ionic compound IC-5 represented by the following formula.

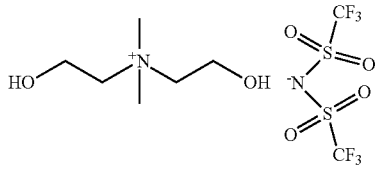

(Synthesis of Ionic Compound IC-6)

8-dimethylamino-1-octanol (manufactured by Tokyo Chemical Industry Co., Ltd.) was dissolved in 35.0 g of tetrahydrofuran. Next, the reaction system was brought in a nitrogen atmosphere, and subsequently, a solution obtained by dissolving 24.9 g of methyl iodide (manufactured by Tokyo Chemical Industry Co., Ltd.) in 80.0 g of tetrahydrofuran was dropped over 30 minutes. The reaction solution was heated and refluxed for 12 hours, 100 ml of water was then added, and the solvent was distilled off under reduced pressure. 100 ml of ethanol was added to the residue, the resulting mixture was stirred at room temperature, the insoluble matter was removed by filtration over celite, and the solvent was then distilled off under reduced pressure again.

The obtained product was dissolved in 160 ml of pure water, 49.4 g of potassium N,N-bis(nonafluorobutanesulfonyl)imide (trade name: EF-N442 manufactured by Mitsubishi Materials Electronic Chemicals Co., Ltd.) was added as an anion raw material, and the resulting mixture was stirred at room temperature for 1 hour. Next, the reaction solution was extracted twice using 100.0 g of ethyl acetate. Next, the separated ethyl acetate layer was washed three times using 60 g of ion-exchange water. Subsequently, ethyl acetate was distilled off under reduced pressure to obtain an ionic compound IC-6 represented by the following formula.

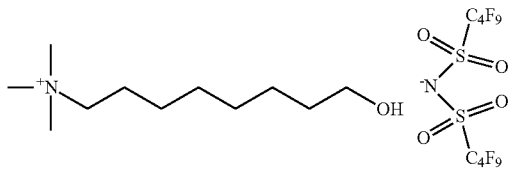

Cations and anions of the ionic compounds IC-1 to IC-6 obtained as described above are shown in Table 1.

TABLE 1

| No. | Cation structure | Terminal functional group | Anion |
|---|---|---|---|
| IC-1 | Tris(2-hydroxyethyl)methyl-ammonium | Hydroxyl group | $CF_3COO^-$ |
| IC-2 | (2-Hydroxyethyl)trimethylammonium | | $(FSO_2)_2N^-$ |
| IC-3 | Bis(2-aminoethyl)dimethyl-ammonium | Amino group | $(CN_2)N^-$ |
| IC-4 | Glycidyltrimethylammonium | Glycidyl group | $NCS^-$ |
| IC-5 | Bis(2-hydroxyethyl)dimethyl-ammonium | Hydroxyl group | $(CF_3SO_2)_2N^-$ |
| IC-6 | (8-Hydroxyoctyl)trimethylammonium | | $(C_4F_6SO_2)_2N^-$ |

<Synthesis of Isocyanate Group-Terminated Urethane Prepolymer>

(Synthesis of Isocyanate Group-Terminated Urethane Prepolymer B-1)

100.0 parts by mass of PTG-L1000 (trade name) (manufactured by Hodogaya Chemical Co., Ltd.) was gradually dropped to 84.1 parts by mass of polymeric MDI (trade name: MILLIONATE MR-200 manufactured by Nippon Polyurethane Industry Co., Ltd.) in a reaction vessel in a nitrogen atmosphere while the inside of the reaction vessel was held at a temperature of 65° C. After the dropping, the resulting mixture was reacted at a temperature of 65° C. for 2.5 hours, and 80.0 parts by mass of methyl ethyl ketone was added. The obtained reaction mixture was cooled to room temperature to obtain an isocyanate group-terminated urethane prepolymer B-1 having an isocyanate group content of 5.4% by mass.

(Synthesis of Isocyanate Group-Terminated Urethane Prepolymer B-2)

100.0 parts by mass of PTG-2000 (trade name) (manufactured by Hodogaya Chemical Co., Ltd.) was gradually dropped to 84.1 parts by mass of polymeric MDI (trade name: MILLIONATE MR-200 manufactured by Nippon Polyurethane Industry Co., Ltd.) in a reaction vessel in a nitrogen atmosphere while the inside of the reaction vessel was held at a temperature of 65° C. After the dropping, the resulting mixture was reacted at a temperature of 65° C. for 2.5 hours, and 80.0 parts by mass of methyl ethyl ketone was added. The obtained reaction mixture was cooled to room temperature to obtain an isocyanate group-terminated urethane prepolymer B-2 having an isocyanate group content of 4.5% by mass.

<Preparation of Development Roller>

Example 1

(Provision of Substrate)

A substrate, which was obtained by applying a primer (trade name: DY39-012 manufactured by Dow Corning Toray Co., Ltd.) was applied to a core metal made of stainless steel (SUS 304) and having a diameter of 6 mm, and baking the applied primer, was provided.

(Formation of Elastic Layer)

The substrate provided as described above was disposed in a mold, and an addition-type silicone rubber composition obtained by mixing the following materials was injected into a cavity formed in the mold.

Liquid silicone rubber material (trade name: SE 6905A/B manufactured by Dow Corning Toray Co., Ltd.): 100.0 parts by mass Carbon black (trade name: TOKABLACK #4300 manufactured by Tokai Carbon Co., Ltd.): 15.0 parts by mass Platinum catalyst: 0.1 parts by mass Subsequently, by heating the mold, the silicone rubber was vulcanized at a temperature of 150° C. for 15 minutes to be cured. The substrate with a cured silicone rubber layer formed on a peripheral surface thereof was removed from the mold, and the core metal was then further heated at 180° C. for 1 hour to complete the curing reaction of the silicone rubber layer. In this way, an elastic roller D-1 having a silicone rubber elastic layer having a diameter of 12 mm on the outer periphery of a substrate was prepared.

(Formation of Resin Layer)

As materials for the resin layer, the following materials were mixed, and stirred.

Polyether polyol (trade name: PTG-L1000 manufactured by Hodogaya Chemical Co., Ltd.): 23.7 parts by mass Isocyanate group-terminated urethane prepolymer B-1: 63.2 parts by mass Ionic compound IC-1: 2.13 pars by mass Carbon black (trade name: Special Black 250 manufactured by Orion Engineered Carbons S.A.): 15.0 parts by mass Urethane resin fine particle (trade name: Art Peral JB-400T manufactured by Negami Chemical Industrial Co., Ltd.): 15.0 parts by mass Next, methyl ethyl ketone was added such that the total solid proportion was 30% by mass, and the resulting mixture was mixed by a sand mill. Then, further, the viscosity was adjusted to 10 to 12 cps with methyl ethyl ketone to prepare a coating material for formation of a resin layer.

The previously prepared elastic roller D-1 was immersed in the coating material for formation of a resin layer to form a coating film of the coating material on the surface of the elastic layer of the elastic roller D-1, and the elastic roller D-1 was dried. Further, heating treatment was performed at 150° C. for 1 hour to prepare a development roller of Example 1 which had a resin layer having a thickness of about 15 μm on the outer periphery of an elastic layer.

Examples 2 to 8 and Examples 11 to 20

Development rollers of Examples 2 to 8 and Examples 11 to 20 were prepared in the same way as in Example 1 except that the types and the amounts of the ionic compound, polyol, isocyanate and carbon black blended were changed as shown in Table 2.

TABLE 2

| | Ionic compound | | Polyol | | Isocyanate | | Carbon black | | Resin particle | |
|---|---|---|---|---|---|---|---|---|---|---|
| | No. | Content (parts by mass) | No. | Content (parts by mass) | No. | Content (parts by mass) | No. | Content (parts by mass) | No. | Content (parts by mass) |
| Example 1 | IC-1 | 2.13 | PTG-L1000 | 23.7 | B-1 | 63.2 | Special Black | 15.0 | JB-400T | 15.0 |
| Example 2 | IC-2 | 1.93 | | 27.6 | | 57.8 | 250 (*1) | | | |
| Example 3 | IC-3 | 1.35 | | 25.9 | | 61.0 | | | | |
| Example 4 | IC-4 | 1.19 | | 28.0 | | 58.5 | | | | |
| Example 5 | IC-5 | 2.82 | | 25.3 | | 59.8 | | | | |
| Example 6 | | | | | | | MA-14 (*2) | | | |
| Example 7 | | | | | | | MA-77 (*2) | | | |
| Example 8 | | | | | | | SUNBLACK | | | |
| Example 9 | | | SANNIX PP-1000 (manufactured by Sanyo Chemical Industries, Ltd.) | 22.0 | B-2 | 64.5 | X55 (*3) | | | |
| Example 10 | | | NIPPOLAN 4009 (manufactured by Tosoh Corporation) | 49.1 | MILLIONATE MR200 (manufactured by Tosoh Corporation) | 18.1 | | | | |
| Example 11 | | 4.72 | PTG-L1000 | 21.9 | B-1 | 62.0 | MA-14 (*2) | 15.0 | | |
| Example 12 | | 2.82 | | 27.5 | | 63.9 | | 10.0 | | |
| Example 13 | | 0.47 | | 26.1 | | 50.7 | | 23.0 | | |
| Example 14 | | | | 23.0 | | 45.0 | | 30.0 | | |
| Example 15 | | 2.82 | | 23.7 | | 63.2 | Printex 25 (*1) | 15.0 | | |
| Example 16 | | | | | | | #25 (*2) | | | |
| Example 17 | | | | | | | SUNBLACK 605 (*3) | | | |
| Example 18 | IC-6 | 5.23 | | 26.2 | | 55.1 | HIBLACK 160B (*1) | | | |
| Example 19 | | | | | | | 7360SB (*4) | | | |
| Example 20 | | | | | | | 45L(*2) | | | |
| Example 21 | | | | | | | SUNBLACK X55 | 7.5 | | |
| | | | | | | | SUNBLACK 235 (*3) | 7.5 | | |

(1*); manufactured by Orion Engineered Carbons Company
(2*); manufactured by Mitsubishi Chemical Corporation
(3*); manufactured by Asahi Carbon Co., Ltd.
(4*); manufactured by Tokai Carbon Co., Ltd.

Example 9

As materials for the resin layer, the following materials were mixed, and stirred.

Polyether polyol (trade name: SANNIX PP-1000 manufactured by Sanyo Chemical Industries, Ltd.): 22.0 parts by mass Isocyanate group-terminated urethane prepolymer B-2: 64.5 parts by mass Ionic compound IC-5: 2.82 parts by mass Carbon black (trade name: SUNBLACK X55 manufactured by Asahi Carbon Co., Ltd.): 15.0 parts by mass Urethane resin fine particle (trade name: Art Peral JB-400T manufactured by Negami Chemical Industrial Co., Ltd.): 15.0 parts by mass Subsequently, a development roller of Example 9 was prepared in the same way as in Example 1.

Example 10

As materials for the resin layer, the following materials were mixed, and stirred.

Polyester polyol (trade name: NIPPOLAN 4009 manufactured by Tosoh Corporation): 49.1 parts by mass Polyisocyanate (trade name: MILLIONATE MR200 manufactured by Tosoh Corporation): 18.1 parts by mass Ionic compound IC-5: 2.82 parts by mass Carbon black (trade name: SUNBLACK X55 manufactured by Asahi Carbon Co., Ltd.): 15.0 parts by mass Urethane resin fine particle (trade name: Art Peral JB-400T manufactured by Negami Chemical Industrial Co., Ltd.): 15.0 parts by mass Subsequently, a development roller of Example 10 was prepared in the same way as in Example 1.

Example 21

As materials for the resin layer, the following materials were mixed, and stirred.

Polyether polyol (trade name: PTG-L1000 manufactured by Hodogaya Chemical Co., Ltd.): 23.7 parts by mass Isocyanate group-terminated urethane polymer B-1: 63.2 parts by mass Ionic compound IC-1: 2.13 parts by mass Carbon black (trade name: SUNBLACK X15 manufactured by Asahi Carbon Co., Ltd.): 7.5 parts by mass Carbon black (trade name: SUNBLACK 235 manufactured by Asahi Carbon Co., Ltd.): 7.5 parts by mass Urethane resin fine particle (trade name: Art Peral JB-400T manufactured by Negami Chemical Industrial Co., Ltd.): 15.0 parts by mass Subsequently, a development roller of Example 21 was prepared in the same way as in Example 1.

Comparative Examples 1 to 9

Development rollers of Comparative Examples 1 to 9 were prepared in the same way as in Example 1 except that the types and the amounts of the ionic compound and carbon black blended were changed as shown in Table 3.

TABLE 3

| | Ionic compound | | Carbon black | |
|---|---|---|---|---|
| | No. | Content (parts by mass) | No. | Content (parts by mass) |
| Comparative Example 1 | Tetra-n-butylammonium trifluoromethanesulfonate (manufactured by Tokyo Chemical Industry Co., Ltd.) | 1.93 | 7360SB (*4) | 15.0 |
| Comparative Example 2 | IC-2 | | Printex G (*1) | |
| Comparative Example 3 | | | #1000 (*2) | |
| Comparative Example 4 | | | Arosperse15 (*1) | |
| Comparative Example 5 | | | Asahi #50U (*3) | |
| Comparative Example 6 | IC-3 | 1.35 | MA-100 (*2) | |
| Comparative Example 7 | | | MA-230 (*2) | |
| Comparative Example 8 | | | SUNBLACK X15 (*3) | |
| Comparative Example 9 | | | DENKA BLACK (*5) | |

(*1); manufactured by Orion Engineered Carbons Company
(*2); manufactured by Mitsubishi Chemical Corporation
(*3); manufactured by Asahi Carbon Co., Ltd.
(*4); manufactured by Tokai Carbon Co., Ltd.
(*5); manufactured by Denki Kagaku Kogyo K.K.

<Analysis 1: BET Specific Surface Area of Carbon Black>

32 g of resin layers peeled from a plurality of development rollers of Example 1, 320 ml of diethanolamine (manufactured by Tokyo Chemical Industry Co., Ltd.) as a decomposing agent, and 1.5 ml of pure water were added in a flask equipped with a Dimroth condenser, and the resulting mixture was heated and refluxed at 160° C. for 20 hours with stirring. 300 ml of MEK was added to the solution after reaction, and the resulting mixture was centrifuged. Further, the centrifuged product was washed with 200 ml of MEK twice, centrifuged, and then dried under reduced pressure to obtain 1.4 g of carbon black contained in 32 g of a resin layer as a surface layer.

This operation was repeatedly performed to obtain total 40 g of carbon black.

The BET specific surface area of the obtained carbon black was measured using a specific surface area measuring apparatus: JEMINI VII 2390 (manufactured by Shimadzu Corporation).

The value of the BET specific surface area measured in this operation was identical to the value measured before use of the carbon black for formation of the resin layer.

<Analysis-2: DBP Absorption of Carbon Black>

Carbon black was obtained from the resin layers of a plurality of development rollers of Example 1 in the same manner as in measurement of the BET specific surface area. The DBP absorption was measured using ABSORPTO METER Model C (manufactured by Brabender GmbH & Co. KG) in conformity to JIS K6217. 40 g of carbon black was placed in a mixing chamber, and measurement was performed at a dropping rate of 4.0 ml/min and a rotation speed of 125 rpm until a maximum torque value was observed. A value (amount of DBP oil dropped per 100 g of carbon black) calculated from the amount of the oil dropped at each of three points: the maximum torque value, the value of 70% of the maximum torque and the value of 30% of the maximum torque was determined, and defined as a DBP absorption at each point. The value of 70% of the maximum torque in the DBP oil absorption measured in this operation was identical to the value measured before use of the carbon black for formation of the resin layer.

<Analysis-3: Ionic Equivalent Z1 (Eq) of Resin of Structural Formula (1) Contained in 1 Part by Mass of Resin Layer>

5.0 g of lithium bromide (special grade reagent) (manufactured by Kishida Chemical Co., Ltd.) was dissolved in a mixed liquid of 65.0 g of pure water and 30.0 g of acetonitrile to prepare a 5% lithium bromide solution.

Next, 1.0 g of resin layers peeled from a plurality of development rollers of Example 1, and 180 ml of the 5% lithium bromide solution were added in a flask equipped with a Dimroth condenser, and the resulting mixture was heated and refluxed at 82° C. for 12 hours with stirring. By this operation, counter anions to ammonium cations contained in the resin layer are replaced by bromide ions. Therefore, a change in ionic equivalent of bromide ions before and after this operation is equal to the ionic equivalent of ammonium cations.

Next, the originally prepared 5% lithium bromide solution, and the 5% lithium bromide solution after the resin layers as surface layers were added and the resulting mixture was heated and refluxed for 12 hours were sampled, and diluted to 250 times with pure water to prepare a measurement liquid.

Next, using Liquid Chromatography Ultimate 3000 (manufactured by thermo Fisher Scientific K.K.), bromide ions were quantitatively determined under the following conditions.

Detector: Corona Veo (100 Hz/3.6 s) (manufactured by thermo Fisher Scientific K.K.)

Column: Acclaim Trinity P1, 2.1×100 mm, 3 (manufactured by thermo Fisher Scientific K.K.)

Development solvent: acetonitrile:ammonium formate=65:35 (v:v)

Development phase velocity: 0.5 ml/min

Development phase temperature: 30° C.

The ionic equivalent of ammonium cations contained in 1 part by mass of the resin layer was calculated from a difference in concentration of bromide ions before and after the resin layers were added and the resulting mixture was heated and refluxed for 12 hours.

Subsequently, for drawing a calibration curve, a standard solution of lithium bromide was diluted stepwise to 100 ppm, 75 ppm, 50 ppm and 25 ppm, concentrations were measured by LC/MS under the same conditions as described above, and a calibration curve for bromide ions was prepared.

The ionic equivalent of cations contained in the resin layer as a surface layer was calculated from the following equation, where $\alpha i$ is a bromide ion concentration (g/l) of the originally prepared 5% lithium bromide solution, and of is a bromide ion concentration (g/l) of the 5% lithium bromide solution after adding the resin layers as surface layers and heating and refluxing the resulting mixture for 12 hours.

$$Z1(eq)=(\alpha i-\alpha f)\times 0.18/79.9$$

The resin layer heated and refluxed for 12 hours in the 5% lithium bromide solution once was heated and refluxed for 12 hours in the 5% lithium bromide solution again, and subjected to the same measurement as described above, and the result showed that there was no change in bromide ion concentration before and after the resin layer was heated and refluxed.

<Analysis-4: Content Z2 (Parts by Mass) of Carbon Black Contained in 100 Parts by Mass of Resin Layer>

32 g of resin layers peeled from a plurality of development rollers of Example 1, 320 ml of diethanolamine (manufactured by Tokyo Chemical Industry Co., Ltd.) as a decomposing agent, and 1.5 ml of pure water were added in a flask equipped with a Dimroth condenser, and the resulting mixture was heated and refluxed at 160° C. for 20 hours with stirring. 300 ml of MEK was added to the solution after reaction, and the resulting mixture was centrifuged. Further, the centrifuged product was washed with 200 ml of MEK twice, centrifuged, and then dried under reduced pressure to obtain 1.4 g of carbon black contained in 32 g of a resin layer as a surface layer.

<Analysis-5: Percentage Z3(%) of Cross-Sectional Area of Resin Particle in Cross-Sectional Area of Resin Layer>

The resin layer of the development roller obtained in Example 1 was cut in a circumferential direction, and a cross-section was observed at a magnification of 300 times using a video microscope. In a randomly selected visual field area of 200 μm×200 μm, the value of "(200 μm×200 μm)−(total area of cross-section of resin particle) was calculated. For each sample, the operation was performed five times at each of three points being 15 mm away from the central part of the roller and both ends of the resin layer of the roller, respectively, and a resin particle cross-sectional area ratio of samples different in the amount of resin particle added was determined. This value is well correlated with the actual blending ratio.

<Analysis-6: d90 Z4 (m) in Cumulative Distribution of Area-Equivalent Diameter of Resin Particle in Cross-Sectional Area of Resin Layer>

The resin layer of the development roller of Example 1 was cut in a circumferential direction, and a cross-section was observed at a magnification of 300 times using a video microscope. All of samples in which a cross-section of a resin particle completely appeared in an observation screen were selected, and an area-equivalent diameter (a diameter of a circle having an area equal to a projected area) was determined for each of 500 samples. In the case where the number of measured samples was less than 500, the roller was rotated in the circumferential direction, the resin layer was additionally cut while the position in an axial direction was not changed, and measurement was performed until the number of measured samples reached 500. This operation was performed five times at each of three points being 15 mm away from the central part of the roller and both ends of the resin layer of the roller, respectively, and total 1500 area-equivalent diameters were measured. Next, a cumulative distribution of the area-equivalent diameters was prepared, and d90 was calculated.

<Analysis-7: pH of Carbon Black>

200 ml of purified water was added to 12.0 g of carbon black obtained in the same manner as in measurement of the BET specific surface area, and the resulting mixture was stirred with a magnetic stirrer at room temperature for 30 minutes. Rotation was stopped, and the mixture was left standing for 5 minutes. The pH value of the supernatant was measured using a pH measuring apparatus (LAQUA F-74 manufactured by HORIBA, Ltd.) and a measuring electrode (9615-S10D manufactured by HORIBA, Ltd.).

<Evaluation of Development Roller>

The following evaluations were performed for the obtained development rollers of Examples 1 to 21 and Comparative Examples 1 to 9.

<Evaluation of the Number of Falling Resin Particles>

A process cartridge for a laser printer (trade name: LBP 7700C manufactured by Canon Inc.), which has a configuration as shown in FIG. 4, was loaded with the development roller obtained in each of Examples and Comparative Examples as the development roller 16.

Next, this process cartridge was fixed to a spinning apparatus capable of rotating at any speed, and continuously spun at 840 ppm for 12 hours in an environment at 23° C. and 50% RH.

After spinning, the development roller was taken out, a toner on the surface was removed, and the surface of the roller was then observed at a magnification of 500 times using a video microscope.

The observation was made at each of three points being 15 mm away from the central part of the roller and both ends of the resin layer of the roller, respectively, and the sum of the numbers of falling resin particles was defined as the number of falling resin particles.

<Evaluation of Output Image>

For evaluation of filming, an evaluation machine modified such that a laser printer (trade name: LBP 7700C manufactured by Canon Inc.) having a configuration as in FIG. 3 had a discharge speed of 60 sheets/minute was used. A process cartridge for the printer was loaded with the development roller of each of Examples and Comparative Examples, and evaluation was performed. Continuous printing was performed at a coverage rate of 0.5% using a black toner in an environment at an atmospheric temperature of 15° C. and a relative humidity of 10% RH.

An image was checked at an output of 20,000 sheets and at an output of 30,000 sheets, and toner sticking (filming) caused by falling of a resin particle was evaluated.

A: Filming is not observed at all.

B: Very slight filming is observed at an end.

C: Noticeable filming is observed throughout an image.

Results of the analyses and evaluations are shown in Tables 4, 5 and 6.

TABLE 4

| | Trade name of carbon black | BET specific surface area ($m^2/g$) | DBP absorption amount: Torque value at 70% | DBP absorption amount: Maximum torque value | DBP absorption amount: Torque value at 30% | [DBP absorption amount at maximum torque] − [DBP absorption amount at 30% torque] | pH |
|---|---|---|---|---|---|---|---|
| Example 1 | Special Black 250 | 41 | 46 | 49 | 29 | 20 | 3.1 |
| Example 2 | | 40 | 47 | 51 | 32 | 19 | 3.0 |
| Example 3 | | 40 | 47 | 52 | 30 | 22 | 3.0 |
| Example 4 | | 41 | 46 | 48 | 26 | 22 | 3.2 |
| Example 5 | | 41 | 48 | 52 | 31 | 21 | 3.1 |
| Example 6 | MA-14 | 56 | 73 | 82 | 49 | 33 | 3.0 |
| Example 7 | MA-77 | 133 | 68 | 72 | 54 | 18 | 2.5 |
| Example 8 | SUNBLACK X55 | 84 | 77 | 84 | 65 | 19 | 3.0 |
| Example 9 | | 84 | 79 | 86 | 67 | 19 | 3.1 |
| Example 10 | | 84 | 79 | 84 | 65 | 19 | 3.1 |
| Example 11 | MA-14 | 56 | 73 | 87 | 64 | 23 | 3.0 |
| Example 12 | | 56 | 71 | 87 | 65 | 22 | 3.1 |
| Example 13 | | 57 | 74 | 89 | 63 | 26 | 3.1 |
| Example 14 | | 56 | 73 | 90 | 65 | 25 | 3.1 |
| Example 15 | Printex 25 | 45 | 45 | 49 | 25 | 24 | 9.0 |
| Example 16 | #25 | 55 | 69 | 75 | 45 | 30 | 8.0 |
| Example 17 | SUNBLACK 605 | 85 | 77 | 82 | 48 | 34 | 7.5 |
| Example 18 | HIBLACK 160B | 36 | 85 | 90 | 50 | 40 | 8.8 |
| Example 19 | #7360SB | 77 | 87 | 92 | 56 | 36 | 7.5 |
| Example 20 | #45L | 125 | 45 | 48 | 27 | 21 | 8.0 |
| Example 21 | SUNBLACK X15/SUNBLACK235 | 76 | 67 | 93 | 42 | 51 | 5.4 |

TABLE 5

| | Ionic equivalent of resin of structural formula (1) contained in 100 parts by mass of resin layer (Z1) | Content (parts by mass) of carbon black contained in 100 parts by mass of resin layer (Z2) | Proportion of cross-sectional area of resin particle in cross-sectional area of resin layer (Z3) | d90 in cumulative distribution of area-equivalent diameter of resin particle in cross-section of resin layer (Z4) | Z2/Z1 | Z3/(Z2 · Z4) | Number of falling particles in taper abrasion test | Filming in durability test |
|---|---|---|---|---|---|---|---|---|
| Example 1 | 6.81E−03 | 15.3 | 19.64 | 15.26 | 2247 | 0.0841 | 0 | A |
| Example 2 | 6.77E−03 | 15.5 | 19.60 | 14.67 | 2290 | 0.0862 | 0 | A |
| Example 3 | 6.78E−03 | 15.1 | 19.57 | 14.77 | 2227 | 0.0877 | 0 | A |
| Example 4 | 6.80E−03 | 15.0 | 19.55 | 14.61 | 2206 | 0.0892 | 0 | A |
| Example 5 | 6.81E−03 | 15.0 | 19.59 | 14.56 | 2203 | 0.0897 | 0 | A |
| Example 6 | 6.81E−03 | 15.5 | 19.61 | 14.66 | 2276 | 0.0863 | 0 | A |
| Example 7 | 6.84E−03 | 15.0 | 19.63 | 14.60 | 2193 | 0.0896 | 0 | A |
| Example 8 | 6.83E−03 | 14.7 | 19.64 | 14.67 | 2152 | 0.0911 | 0 | A |
| Example 9 | 6.77E−03 | 14.9 | 19.64 | 14.69 | 2201 | 0.0897 | 1 | A |
| Example 10 | 6.82E−03 | 15.5 | 19.61 | 14.57 | 2273 | 0.0868 | 2 | A |
| Example 11 | 1.14E−02 | 15.0 | 19.61 | 14.55 | 1322 | 0.0899 | 6 | A |
| Example 12 | 6.81E−03 | 10.0 | 19.61 | 14.59 | 1468 | 0.1344 | 0 | A |
| Example 13 | 1.14E−03 | 23.0 | 19.66 | 14.67 | 20175 | 0.0583 | 0 | A |
| Example 14 | 1.14E−03 | 30.0 | 19.64 | 14.61 | 26316 | 0.0448 | 8 | A |
| Example 15 | 6.85E−03 | 14.7 | 19.71 | 14.67 | 2146 | 0.0914 | 0 | A |
| Example 16 | 6.87E−03 | 14.9 | 19.62 | 14.55 | 2169 | 0.0905 | 1 | A |

TABLE 5-continued

| | Ionic equivalent of resin of structural formula (1) contained in 100 parts by mass of resin layer (Z1) | Content (parts by mass) of carbon black contained in 100 parts by mass of resin layer (Z2) | Proportion of cross-sectional area of resin particle in cross-sectional area of resin layer (Z3) | d90 in cumulative distribution of area-equivalent diameter of resin particle in cross-section of resin layer (Z4) | Z2/Z1 | Z3/(Z2 · Z4) | Number of falling particles in taper abrasion test | Filming in durability test |
|---|---|---|---|---|---|---|---|---|
| Example 17 | 6.76E−03 | 15.0 | 19.63 | 14.64 | 2219 | 0.0894 | 2 | A |
| Example 18 | 6.80E−03 | 15.0 | 19.60 | 14.61 | 2206 | 0.0894 | 2 | A |
| Example 19 | 6.80E−03 | 15.3 | 19.67 | 14.71 | 2250 | 0.0874 | 0 | A |
| Example 20 | 6.84E−03 | 15.0 | 19.57 | 14.75 | 2193 | 0.0885 | 0 | A |
| Example 21 | 6.65E−03 | 15.3 | 19.65 | 14.69 | 2301 | 0.0874 | 15 | B |

TABLE 6

| | Ionic compound | Carbon black: Trade name | Carbon black: BET specific surface area ($m^2/g$) | DBP absorption amount 70% Torque value | Number of falling particles in taper abrasion test | Filming in durability test |
|---|---|---|---|---|---|---|
| Comparative Example 1 | Tetra-n-butylammonium trifluoromethanesulfonate | 7360SB | 77 | 87 | 30 | C |
| Comparative Example 2 | IC-2 | Printex G | 29 | 98 | 41 | C |
| Comparative Example 3 | | #1000 | 177 | 61 | 55 | C |
| Comparative Example 4 | | Arosperse15 | 11 | 40 | 52 | C |
| Comparative Example 5 | | Asahi #50U | 27 | 64 | 39 | C |
| Comparative Example 6 | IC-2 | MA-100 | 109 | 102 | 44 | C |
| Comparative Example 7 | | MA-230 | 75 | 112 | 33 | C |
| Comparative Example 8 | | SUNBLACK X15 | 116 | 97 | 32 | C |
| Comparative Example 9 | | DENKA BLACK | 72 | 171 | 49 | C |

The development rollers of Examples 1 to 21 had a small number of falling resin particles in the taper abrasion test, and maintained favorable image quality because the resin layer contained a urethane resin having a specific structure and carbon black having a specific property. Particularly in Examples 1 to 20 where [DBP absorption amount at maximum torque]−[DBP absorption amount at 30% torque] in DBP absorption measurement was 40 ml/100 g or less, falling of a resin particle was suppressed at a higher level.

Further, in Examples 1 to 10, Example 12, Example 13 and Examples 15 to 21 where the ionic equivalent of cations contained in the structure of the urethane resin contained in the resin layer as a surface layer, and the proportion of carbon black each fell within a specific range, falling of a resin particle was suppressed at a very high level.

On the other hand, the development rollers of Comparative Example 1 where the urethane resin did not have a structure of structural formula (1) and Comparative Examples 2 to 9 where the carbon black was not contained had a large number of falling resin particles in the taper abrasion test, and suffered from occurrence of filming due to falling of a resin particle in evaluation of durability.

<Preparation of Charging Roller>

Example 22

(Formation of Elastic Layer)

The below-described types and amounts of materials were mixed by a pressure-type kneader to obtain a rubber composition kneaded in process A.

NBR rubber (trade name: Nipol DN219 manufactured by Zeon Corporation)/40.0 parts by mass of carbon black (trade name: TOKABLACK #4300 manufactured by Tokai Carbon Co., Ltd.): 100 parts by mass Calcium carbonate (trade name: NANOX #30 manufactured by Maruo Calcium Co., Ltd.): 20.0 parts by mass Stearic acid (trade name: Stearic Acid S manufactured by Kao Corporation): 1.0 part by mass Further, 166.0 parts by mass of the rubber composition kneaded in process A and the below-described types and amounts of materials were mixed by an open roll to prepare an unvulcanized rubber composition.

Sulfur (trade name: Sulfax 200S manufactured by Tsurumi Chemical Industry Co., Ltd.): 1.2 parts by mass Tetrabenzylthiuram disulfide (trade name: TBZTD manufactured by Sanshin Chemical Industry Co., Ltd.): 4.5 parts by mass Next, a crosshead extruder having a supply mechanism for an electro-conductive axial core and a discharge mechanism for an unvulcanized rubber roller was provided, a die having an inner diameter of 16.5 mm was attached to a crosshead, the extruder and the crosshead were adjusted to 80° C., and the conveyance speed of the electro-conductive axial core was adjusted to 60 mm/sec. Under these conditions, the unvulcanized rubber composition was supplied by the extruder, and the electro-conductive axial core was covered with the unvulcanized rubber composition as an elastic layer in the crosshead to obtain an unvulcanized rubber roller. Next, the unvulcanized rubber roller was placed in a hot-air vulcanization furnace at 170° C., and heated for 60 minutes to obtain an unpolished electro-conductive roller. Thereafter, the ends of the elastic layer were cut off, and removed, and the surface of the elastic layer was polished with a rotary grindstone. In this way, an elastic roller D-2 having a diameter of 8.4 mm at a position 90 mm away from the central part toward each of both ends, and a diameter of 8.5 mm at the central part was prepared.

(Formation of Resin Layer)

As materials for the resin layer, the following materials were mixed, and stirred.

- Polyether polyol (trade name: PTG-L1000 manufactured by Hodogaya Chemical Co., Ltd.): 10.5 parts by mass
- Isocyanate group-terminated urethane polymer B-1: 51.4 parts by mass
- Ionic compound IC-1: 3.57 parts by mass
- Carbon black (trade name: Special Black 250 manufactured by Orion Engineered Carbons S.A.): 20.0 parts by mass
- Urethane resin fine particle (trade name: Dynamic Beads UCN-5150D manufactured by Dainichiseika Color & Chemicals Mfg. Co., Ltd.): 30.0 parts by mass Next, methyl ethyl ketone was added such that the total solid proportion was 30% by mass, and the resulting mixture was mixed by a sand mill. Then, further, the viscosity was adjusted to 10 to 12 cps with methyl ethyl ketone to prepare a coating material for formation of a resin layer.

The previously prepared elastic roller D-2 was immersed in the coating material for formation of a resin layer to form a coating film of the coating material on the surface of the elastic layer of the elastic roller D-2, and the elastic roller D-2 was dried. Further, heating treatment was performed at 150° C. for 1 hour to prepare a charging roller of Example 22 which had a resin layer having a thickness of about 15 μm on the outer periphery of an elastic layer.

Example 23

A charging roller of Example 23 was prepared in the same way as in Example 22 except that the type of carbon black was changed to that described in Table 7.

Example 24

As materials for the resin layer, the following materials were mixed, and stirred.

- Polyether polyol (trade name: SANNIX PP-1000 manufactured by Sanyo Chemical Industries, Ltd.): 7.7 parts by mass
- Isocyanate group-terminated urethane polymer B-2: 55.4 parts by mass
- Ionic compound IC-1: 3.57 parts by mass
- Carbon black (trade name: MA-14 manufactured by Mitsubishi Chemical Corporation): 20.0 parts by mass
- Urethane resin fine particle (trade name: Dynamic Beads UCN-5150D manufactured by Dainichiseika Color & Chemicals Mfg. Co., Ltd.): 30.0 parts by mass Subsequently, a charging roller of Example 24 was prepared in the same way as in Example 22.

Example 25

As materials for the resin layer, the following materials were mixed, and stirred.

- Polyether polyol (trade name: NIPPOLAN 4009 manufactured by Tosoh Corporation): 30.9 parts by mass
- Polyisocyanate (trade name: MILLIONATE MR200 manufactured by Tosoh Corporation): 15.6 parts by mass
- Ionic compound IC-1: 3.57 parts by mass
- Carbon black (trade name: MA-14 manufactured by Mitsubishi Chemical Corporation): 20.0 parts by mass
- Urethane resin fine particle (trade name: Dynamic Beads UCN-5150D manufactured by Dainichiseika Color & Chemicals Mfg. Co., Ltd.): 30.0 parts by mass Subsequently, a charging roller of Example 25 was prepared in the same way as in Example 22.

Examples 26 to 34

Charging rollers of Examples 26 to 34 were prepared in the same way as in Example 25 except that the types and the amounts of the ionic compound and carbon black blended and the amounts of the polyol and the isocyanate blended were changed as shown in Table 7.

TABLE 7

| | Ionic compound | | Polyol | | Isocyanate | | Carbon black | | Resin particle | |
|---|---|---|---|---|---|---|---|---|---|---|
| | No. | Content (parts by mass) | No. | Content (parts by mass) | No. | Content (parts by mass) | No. | Content (parts by mass) | No. | Content (parts by mass) |
| Example 22 | IC-1 | 3.57 | PTG-L1000 | 10.5 | B-1 | 51.4 | Special Black 250 | 20.0 | UCN-5150D | 30.0 |
| Example 23 | | | | | | | MA-14 | | | |
| Example 24 | | | SANNIX PP-1000 | 7.7 | B-2 | 55.4 | | | | |
| Example 25 | | | NIPPOL AN 4009 | 30.9 | MILLIONATE MR200 | 15.6 | | | | |
| Example 26 | IC-3 | 2.26 | | 33.2 | | 14.5 | Printex 25 | | | |
| Example 27 | | | | | | | #25 | | | |
| Example 28 | | | | | | | HIBLACK 160B | | | |
| Example 29 | | | | | | | 45L | | | |

TABLE 7-continued

| | Ionic compound | | Polyol | | Isocyanate | | Carbon black | | Resin particle | |
|---|---|---|---|---|---|---|---|---|---|---|
| | No. | Content (parts by mass) | No. | Content (parts by mass) | No. | Content (parts by mass) | No. | Content (parts by mass) | No. | Content (parts by mass) |
| Example 30 | | | | | | | Printex G<br>Arosperse 15 | 10.0<br>10.0 | | |
| Example 31 | IC-4 | 1.98 | | 34.9 | | 13.2 | 7360SB | 20.0 | | |
| Example 32 | | 1.19 | | 36.0 | | 12.8 | | 10.0 | | 40.0 |
| Example 33 | | | | 28.5 | | 10.4 | | | | 50.0 |
| Example 34 | | 0.10 | | 41.4 | | 13.5 | | 15.0 | | 30.0 |

Comparative Examples 10 to 16

Charging rollers of Comparative Examples 10 to 16 were prepared in the same way as in Example 25 except that the types of the amounts of the ionic compound and carbon black blended were changed as shown in Table 8.

TABLE 8

| | Ionic compound | | Carbon black | |
|---|---|---|---|---|
| | No. | Content (parts by mass) | No. | Content (parts by mass) |
| Comparative Example 10 | Tetra-n-butylammonium trifluoromethanesulfonate (manufactured by Tokyo Chemical Industry Co., Ltd.) | 3.57 | 7360SB | 20.0 |
| Comparative Example 11 | IC-1 | | Printex G | |
| Comparative Example 12 | | | #1000 | |
| Comparative Example 13 | | | Arosperse15 | |
| Comparative Example 14 | | | Asahi #50U | |
| Comparative Example 15 | IC-3 | 2.26 | MA-230 | |
| Comparative Example 16 | | | DENKA BLACK | |

<Evaluation of Charging Roller>

The following evaluations were performed for the obtained charging rollers of Examples 22 to 34 and Comparative Examples 10 to 16.

[Evaluation of the Number of Falling Resin Particles]

A process cartridge for a laser printer (trade name: LBP 7700C manufactured by Canon Inc.), which has a configuration as shown in FIG. 4, was loaded with the charging roller obtained in each of Examples and Comparative Examples as the charging roller 24.

Next, this process cartridge was fixed to a spinning apparatus capable of rotating at any speed, and continuously spun at 840 ppm for 12 hours in an environment at 23° C. and 50% RH.

After spinning, the charging roller was taken out, and observed in the same manner as in evaluation of the development roller, and the number of falling resin particles was measured.

[Evaluation of Output Image]

When a resin particle falls from a charging roller, density unevenness appearing as thin streaks may occur in an electrophotographic image. The density unevenness is particularly noticeable in a half-tone image.

At the time when abnormal discharge occurs at a nip portion between a charging roller and an electrophotographic photosensitive member, a protrusion stemming from a resin particle on the surface of the charging roller can suppress the occurrence of density unevenness appearing as streaks due to the abnormal discharge. This may be because the protrusion plays a role of interrupting abnormal discharge to suppress propagation of the abnormal discharge. However, it is considered that when some of resin particles fall, and thus the number of protrusions on the surface of the charging roller decreases, interruption of abnormal discharge which may occur at the nip portion is unlikely to occur, and density unevenness appearing as streaks easily occurs due to abnormal discharge. The density unevenness appearing as streaks tends to become severer as the number of falling resin particles increases. Therefore, the following evaluation was performed using the charging rollers of Examples.

An electrophotographic laser printer (trade name: HP ColoR LaseRjet EnteRpRise CP4515dn manufactured by Hewlett-Packard Company) was loaded with the charging roller obtained in each of Examples 28, 29 and 30 and Comparative Examples 6 and 7, and a durability test was conducted in which an image (image having a horizontal line with a width of 2 dots and a space of 50 dots in a direction perpendicular to the rotation direction of a photosensitive member) was continuously outputted at a print density of 4% in an environment at an atmospheric temperature of 15° C. and a relative humidity of 10% RH. In addition, a half-tone image (image having a horizontal line with a width of 1 dot and a space of 2 dots in a direction perpendicular to the rotation direction of a photosensitive member) was outputted for checking the image after 24,000 sheets of image were outputted. The obtained image was visually observed, and evaluated for horizontal streaks.

A: Horizontal streaks are not present at all.

B: Horizontal streaks are slightly present only at an end of the image.

C: Horizontal streaks are present over almost half the area of the image, and noticeable.

Results of the evaluation are shown in Tables 9, 10 and 11.

TABLE 9

| | Torque name of carbon black | BET specific surface area ($m^2/g$) | DBP absorption amount: 70% Torque value | DBP absorption amount: Maximum torque value | DBP absorption amount: 30% Torque value | [DBP absorption amount at maximum torque] − [DBP absorption amount at 30% torque] | pH |
|---|---|---|---|---|---|---|---|
| Example 22 | Special Black 250 | 41 | 46 | 49 | 29 | 20 | 3.1 |
| Example 23 | MA-14 | 58 | 72 | 80 | 49 | 31 | 3.0 |
| Example 24 | | 58 | 75 | 81 | 48 | 33 | 3.0 |
| Example 25 | | 56 | 74 | 79 | 48 | 31 | 3.0 |
| Example 26 | Printex 25 | 45 | 42 | 49 | 25 | 24 | 9.0 |
| Example 27 | #25 | 55 | 69 | 75 | 45 | 30 | 8.0 |
| Example 28 | HIBLACK 160B | 33 | 85 | 90 | 52 | 38 | 8.8 |
| Example 29 | #45L | 125 | 45 | 48 | 27 | 21 | 8.0 |
| Example 30 | Printex G/Arosperse15 | 53 | 76 | 94 | 43 | 51 | 9.0 |
| Example 31 | #7360SB | 76 | 87 | 92 | 56 | 36 | 7.5 |
| Example 32 | | 75 | 86 | 91 | 53 | 38 | 7.5 |
| Example 33 | | 79 | 86 | 95 | 58 | 37 | 7.5 |
| Example 34 | | 79 | 87 | 91 | 57 | 34 | 7.5 |

TABLE 10

| | Ionic equivalent of resin of structural formula (1) contained in 100 parts by mass of resin layer (Z1) | Content (parts by mass) of carbon black contained in 100 parts by mass of resin layer (Z2) | Proportion of cross-sectional area of resin particle in cross-sectional area of resin layer (Z3) | d90 value in cumulative distribution of area-equivalent diameter of resin particle in cross-section of resin layer (Z4) | Z2/Z1 | Z3/(Z2 · Z4) | Number of falling particles in taper abrasion test | Horizontal streaks in durability test |
|---|---|---|---|---|---|---|---|---|
| Example 22 | 1.14E−02 | 19.2 | 37.2 | 6.47 | 1684 | 0.2995 | 0 | A |
| Example 23 | 1.24E−02 | 19.0 | 37.1 | 6.42 | 1532 | 0.3044 | 0 | A |
| Example 24 | 1.16E−02 | 18.8 | 37.2 | 6.44 | 1621 | 0.3073 | 2 | A |
| Example 25 | 1.17E−02 | 18.8 | 37.4 | 6.55 | 1607 | 0.3037 | 3 | A |
| Example 26 | 1.21E−02 | 19.2 | 37.5 | 6.52 | 1587 | 0.2996 | 9 | A |
| Example 27 | 1.13E−02 | 19.1 | 36.9 | 6.56 | 1690 | 0.2945 | 8 | A |
| Example 28 | 1.14E−02 | 18.8 | 37.2 | 6.49 | 1649 | 0.3049 | 6 | A |
| Example 29 | 1.16E−02 | 19.6 | 36.8 | 6.49 | 1690 | 0.2893 | 8 | A |
| Example 30 | 1.19E−02 | 19.4 | 36.9 | 6.47 | 1630 | 0.2940 | 19 | B |
| Example 31 | 1.20E−02 | 19.4 | 37.5 | 6.61 | 1617 | 0.2924 | 0 | A |
| Example 32 | 6.87E−03 | 8.6 | 48.1 | 6.47 | 1252 | 0.8645 | 0 | A |
| Example 33 | 6.81E−03 | 8.7 | 59.3 | 6.49 | 1278 | 1.0502 | 6 | A |
| Example 34 | 5.70E−04 | 15.6 | 37.2 | 6.47 | 27368 | 0.3686 | 8 | A |

TABLE 11

| | Ionic compound | Carbon black: Trade name | Carbon black: BET specific surface area ($m^2/g$) | DBP absorption amount 70% Torque value | Number of falling particles in taper abrasion test | Horizontal streaks in durability test |
|---|---|---|---|---|---|---|
| Comparative Example 10 | Tetra-n-butylammonium trifluoromethanesulfonate | 7360SB | 79 | 85 | 41 | C |
| Comparative Example 11 | IC-2 | Printex G | 30 | 97 | 48 | C |
| Comparative Example 12 | | #1000 | 179 | 63 | 58 | C |

TABLE 11-continued

| Ionic compound | Carbon black Trade name | BET specific surface area ($m^2/g$) | DBP absorption amount 70% Torque value | Number of falling particles in taper abrasion test | Horizontal streaks in durability test |
|---|---|---|---|---|---|
| Comparative Example 13 | Arosperse15 | 9 | 40 | 49 | C |
| Comparative Example 14 | Asahi #50U | 26 | 62 | 44 | C |
| Comparative Example 15 IC-2 | MA-230 | 75 | 116 | 36 | C |
| Comparative Example 16 | DENKA BLACK | 70 | 172 | 57 | C |

The charging rollers of Examples 22 to 34 had a small number of falling resin particles in the taper abrasion test, and maintained favorable image quality because the resin layer contained a urethane resin having a specific structure, and carbon black having a specific property. Particularly in Examples 22 to 29 and Examples 31 to 34 where [DBP absorption amount at maximum torque]−[DBP absorption amount at 30% torque] in DBP absorption measurement was 40 ml/100 g or less, falling of a resin particle was suppressed at a higher level.

Further, in Examples 31 and 32 where the ionic equivalent of cations contained in the structure of the urethane resin contained in the resin layer, and the proportion of carbon black each fell within a specific range, falling of a resin particle was suppressed at a very high level.

On the other hand, the charging rollers of Comparative Example 10 where the urethane resin did not have a structure of structural formula (1) and Comparative Examples 11 to 16 where the carbon black was not contained had a large number of falling resin particles in the taper abrasion test, and suffered from generation of horizontal streaks due to falling of a resin particle in evaluation of durability.

<Preparation of Development Blade>

Example 35

(Provision of Stainless Steel Sheet)

0.08 mm-thick stainless steel (SUS 304 manufactured by Nisshin Steel Co., Ltd.) was press-cut to a length of 200 mm and a width of 23 mm to provide a stainless steel sheet (hereinafter, referred to as a "SUS sheet") as a substrate.

(Formation of Resin Layer)

As materials for the resin layer, the following materials were mixed, and stirred.

- Polyether polyol (trade name: PTG-L1000 manufactured by Hodogaya Chemical Co., Ltd.): 23.5 parts by mass
- Isocyanate group-terminated urethane polymer B-1: 75.7 parts by mass
- Ionic compound IC-1: 3.57 parts by mass
- Carbon black (trade name: Special Black 250 manufactured by Orion Engineered Carbons S.A.): 10.0 parts by mass
- Polyamide resin fine particle (trade name: SP-10 manufactured by Toray Industries, Inc.): 10.0 parts by mass Next, methyl ethyl ketone was added such that the total solid proportion was 30% by mass, and the resulting mixture was mixed by a sand mill. Then, further, the viscosity was adjusted to 10 to 12 cps with methyl ethyl ketone to prepare a coating material for formation of a resin layer.

The previously prepared SUS sheet was immersed in the coating material for formation of a resin layer as prepared above, whereby a coating film of the coating material was formed with the coating film having a length L of 1.5 mm from an end of the SUS sheet on the long side. The coating film was dried. Further, heating treatment was performed at a temperature of 140° C. for 1 hour to prepare a development blade of Example 35 which had a resin layer having a thickness T of 10 μm on the surface of an end of the SUS sheet on the long side.

Example 36

A development blade of Example 36 was prepared in the same way as in Example 35 except that the type and the amount of carbon black blended were changed as shown in Table 12.

Example 37

As materials for the resin layer, the following materials were mixed, and stirred.

- Polyether polyol (trade name: SANNIX PP-1000 manufactured by Sanyo Chemical Industries, Ltd.): 19.3 parts by mass
- Isocyanate group-terminated urethane polymer B-2: 81.6 parts by mass
- Ionic compound IC-1: 3.57 parts by mass
- Carbon black (trade name: MA-14 manufactured by Mitsubishi Chemical Corporation): 10.0 parts by mass
- Polyamide resin fine particle (trade name: SP-10 manufactured by Toray Industries, Inc.): 10.0 parts by mass Subsequently, a development blade of Example 37 was prepared in the same way as in Example 35.

Example 38

As materials for the resin layer, the following materials were mixed, and stirred.

- Polyester polyol (trade name: NIPPOLAN 4009 manufactured by Tosoh Corporation): 53.5 parts by mass
- Polyisocyanate (trade name: MILLIONATE MR200 manufactured by Tosoh Corporation): 22.9 parts by mass
- Ionic compound IC-1: 3.57 parts by mass
- Carbon black (trade name: MA-14 manufactured by Mitsubishi Chemical Corporation): 31.3 parts by mass
- Polyamide resin fine particle (trade name: SP-10 manufactured by Toray Industries, Inc.): 11.6 parts by mass Subsequently, a development blade of Example 38 was prepared in the same way as in Example 36.

Examples 39 to 47

Development blades of Examples 39 to 47 were prepared in the same way as in Example 38 except that the types and the amounts of the ionic compound and carbon black blended, and the amounts of the polyol and the isocyanate blended were changed as shown in Table 12.

TABLE 12

| | Ionic compound | | Polyol | | Isocyanate | | Carbon black | | Resin particle | |
|---|---|---|---|---|---|---|---|---|---|---|
| | No. | Content (parts by mass) | No. | Content (parts by mass) | No. | Content (parts by mass) | No. | Content (parts by mass) | No. | Content (parts by mass) |
| Example 35 | IC-1 | 3.57 | PTG-L1000 | 23.5 | B-1 | 75.7 | Special Black 250 | 10.0 | SP-10 | 10.0 |
| Example 36 | | | | | | | MA-14 | | | |
| Example 37 | | | SANNIX PP-1000 | 19.3 | B-2 | 81.6 | | | | |
| Example 38 | | | NIPPOLAN 4009 | 53.5 | MILLIONATE MR200 | 22.9 | | | | |
| Example 39 | | 2.13 | | 56.3 | | 21.6 | Printex 25 | | | |
| Example 40 | | 0.36 | | 49.9 | | 16.8 | | 23.0 | | |
| Example 41 | | 0.18 | | 56.3 | | 18.6 | | 15.0 | | |
| Example 42 | IC-3 | 2.26 | | 55.9 | | 21.9 | | 10.0 | | |
| Example 43 | | | | | | | #25 | | | |
| Example 44 | | | | | | | HIBLACK 160B | | | |
| Example 45 | IC-4 | 1.98 | | 57.5 | | 20.5 | 7360SB | | | |
| Example 46 | | | | | | | 45L | | | |
| Example 47 | | | | | | | Asahi #50U | 5.0 | | |
| | | | | | | | #1000 | 5.0 | | |

Comparative Examples 17 to 23

Development blades of Comparative Examples 17 to 23 were prepared in the same way as in Example 38 except that the types and the amounts of the ionic compound and carbon black blended were changed as shown in Table 13.

TABLE 13

| | Ionic compound | | Carbon black | |
|---|---|---|---|---|
| | No. | Content (parts by mass) | No. | Content (parts by mass) |
| Comparative Example 17 | Tetra-n-butylammonium trifluoromethanesulfonate (manufactured by Tokyo Chemical Industry Co., Ltd.) | 3.57 | 7360SB | 10.0 |
| Comparative Example 18 | IC-3 | 2.26 | Printex G | |
| Comparative Example 19 | | | #1000 | |
| Comparative Example 20 | | | Arosperse15 | |
| Comparative Example 21 | | | Asahi #50U | |
| Comparative Example 22 | IC-4 | 1.98 | MA-230 | |
| Comparative Example 23 | | | DENKA BLACK | |

<Evaluation of Development Blade>

The following evaluation was performed for the obtained development blades of Examples 35 to 47 and Comparative Examples 17 to 23.

[Evaluation of Number of Falling Resin Particles]

A process cartridge for a laser printer (trade name: HP LaserJet Enterprise Color M553dn), which has a configuration as shown in FIG. 4, was loaded with the development blade obtained in each of Examples and Comparative Examples as the development blade 21.

Next, this process cartridge was fixed to a spinning apparatus capable of rotating at any speed, and continuously spun for 12 hours in an environment at 23° C. and 50% RH (hereinafter, referred to as "N/N") with the spinning apparatus programmed so that the rotation speed of the development roller was 840 ppm.

After spinning, the development blade was taken out, and observed in the same manner as in evaluation for the development roller, and the number of falling resin particles was measured.

For evaluation of longitudinal streaks, an evaluation machine modified so that a laser printer (trade name: HP LaserJet Enterprise Color N553dn manufactured by Hewlett-Packard Company) having a configuration as in FIG. 3 had a discharge speed of 60 sheets/minute was used. A process cartridge for the printer was loaded with the development blade of each of Examples and Comparative Examples, and evaluation was performed. Continuous printing was performed at a coverage rate of 0.5% using a black toner in an environment at an atmospheric temperature of 15° C. and a relative humidity of 10% RH.

When a toner lump sticks to the surface of the development blade due to falling of a resin particle on the surface of the development blade, longitudinal streak-shaped image defects may occur at, for example, a printed section.

An image was checked at an output of 20,000 sheets and at an output of 30,000 sheets, and whether or not the image had longitudinal streaks caused by falling of the resin particle of the development blade was evaluated based on the following criteria.

A: Longitudinal streaks are not observed at all.

B: Very slight longitudinal streaks are observed at an end.

C: Noticeable longitudinal streaks are observed throughout an image.

Evaluation results are shown in Tables 14, 15 and 16.

TABLE 14

| | Trade name of carbon black | BET specific surface area ($m^2/g$) | DBP absorption amount: 70% Torque value | DBP absorption amount: Maximum torque value | DBP absorption amount: 30% Torque value | [DBP absorption amount at maximum torque] − [DBP absorption amount at 30% torque] | pH |
|---|---|---|---|---|---|---|---|
| Example 35 | Special Black 250 | 41 | 45 | 49 | 27 | 22 | 3.1 |
| Example 36 | MA-14 | 56 | 73 | 80 | 47 | 33 | 3.0 |
| Example 37 | | 55 | 74 | 81 | 50 | 31 | 3.0 |
| Example 38 | | 58 | 76 | 79 | 49 | 30 | 3.0 |
| Example 39 | Printex 25 | 45 | 45 | 49 | 27 | 22 | 9.0 |
| Example 40 | | 44 | 45 | 50 | 26 | 24 | 9.0 |
| Example 41 | | 46 | 45 | 49 | 27 | 22 | 9.0 |
| Example 42 | | 46 | 46 | 48 | 27 | 21 | 9.0 |
| Example 43 | #25 | 56 | 70 | 74 | 44 | 30 | 8.0 |
| Example 44 | HIBLACK 160B | 36 | 85 | 89 | 52 | 37 | 8.8 |
| Example 45 | 7360SB | 76 | 90 | 94 | 58 | 36 | 7.5 |
| Example 46 | 45L | 127 | 46 | 48 | 25 | 23 | 8.0 |
| Example 47 | Asahi #50U/#1000 | 114 | 60 | 82 | 31 | 51 | 5.6 |

TABLE 15

| | Ionic equivalent of resin of structural formula (1) contained in 100 parts by mass of resin layer (Z1) | Content (parts by mass) of carbon black contained in 100 parts by mass of resin layer (Z2) | Proportion of cross-sectional area of resin particle in cross-sectional area of resin layer (Z3) | d90 value in cumulative distribution of area-equivalent diameter of resin particle in cross-section of resin layer (Z4) | Z2/Z1 | Z3/(Z2 · Z4) | Number of falling particles in taper abrasion test | Longitudinal streaks in durability test |
|---|---|---|---|---|---|---|---|---|
| Example 35 | 1.14E−02 | 9.4 | 9.3 | 9.66 | 821 | 0.1029 | 1 | A |
| Example 36 | 1.16E−02 | 9.4 | 9.2 | 9.74 | 807 | 0.1009 | 1 | A |
| Example 37 | 1.13E−02 | 9.5 | 9.3 | 9.71 | 836 | 0.1014 | 2 | A |
| Example 38 | 1.17E−02 | 9.4 | 9.2 | 9.74 | 800 | 0.1009 | 3 | A |
| Example 39 | 6.82E−03 | 9.5 | 9.2 | 9.78 | 1393 | 0.0990 | 0 | A |
| Example 40 | 1.13E−03 | 21.9 | 9.1 | 9.74 | 19381 | 0.0427 | 0 | A |
| Example 41 | 5.60E−04 | 14.2 | 9.4 | 9.76 | 25357 | 0.0678 | 5 | A |
| Example 42 | 1.15E−02 | 9.3 | 9.1 | 9.77 | 809 | 0.1002 | 5 | A |
| Example 43 | 1.14E−02 | 9.5 | 9.3 | 9.64 | 833 | 0.1016 | 8 | A |
| Example 44 | 1.21E−02 | 9.5 | 9.5 | 9.69 | 785 | 0.1032 | 6 | A |
| Example 45 | 1.11E−02 | 9.5 | 9.1 | 9.77 | 856 | 0.0980 | 7 | A |
| Example 46 | 1.12E−02 | 9.4 | 9.6 | 9.74 | 836 | 0.1053 | 9 | A |
| Example 47 | 1.14E−02 | 9.5 | 9.3 | 9.74 | 16964 | 0.1005 | 16 | B |

TABLE 16

| | Ionic compound | Carbon black: Trade name | Carbon black: BET specific surface area ($m^2/g$) | DBP absorption amount 70% Torque value | Number of falling particles in taper abrasion test | Longitudinal streaks in durability test |
|---|---|---|---|---|---|---|
| Comparative Example 17 | Tetra-n-butylammonium trifluoromethanesulfonate | 7360SB | 80 | 87 | 48 | C |
| Comparative Example 18 | IC-3 | Printex G | 31 | 98 | 37 | C |
| Comparative Example 19 | | #1000 | 183 | 60 | 41 | C |
| Comparative Example 20 | | Arosperse15 | 11 | 39 | 55 | C |
| Comparative Example 21 | | Asahi #50U | 30 | 62 | 39 | C |
| Comparative Example 22 | IC-4 | MA-230 | 76 | 115 | 50 | C |
| Comparative Example 23 | | DENKA BLACK | 71 | 176 | 46 | C |

The development blades of Examples 35 to 47 had a small number of falling resin particles in the taper abrasion test, and maintained favorable image quality because the resin layer contained a urethane resin having a specific structure and carbon black having a specific property. Particularly in Examples 35 to 46 where [DBP absorption amount at maximum torque]−[DBP absorption amount at 30% torque] in DBP absorption measurement was 40 ml/100 g or less, falling of a resin particle was suppressed at a higher level.

Further, in Examples 39 and 40 where the ionic equivalent of cations contained in the structure of the urethane resin contained in the resin layer, and the proportion of carbon black each fell within a specific range, falling of a resin particle was suppressed at a very high level.

On the other hand, the development blades of Comparative Example 17 where the urethane resin did not have a structure of structural formula (1) and Comparative Examples 18 to 23 where the carbon black was not contained had a large number of falling resin particles in the taper abrasion test, and suffered from generation of longitudinal streaks due to falling of a resin particle in evaluation of durability.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-067877, filed Mar. 30, 2018, which is hereby incorporated by reference herein in its entirety.

What is claimed is:

1. An electrophotographic member, comprising:

an electro-conductive substrate;

a resin layer as a surface layer on the substrate, the resin layer comprising a urethane resin having a structure of formula (1), an anion and a resin particle, the resin layer further comprising carbon black (1)

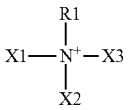

where R1 represents a hydrogen atom, or a monovalent hydrocarbon group having 1 to 12 carbon atoms, X1 to X3 independently represent a structure selected from the group consisting of formulae (X101) to (X103), or a monovalent hydrocarbon group having 1 to 12 carbon atoms, with the proviso that at least one of X1 to X3 is one of formulae (X101) to (X103)

(X101)

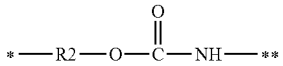

(X102)

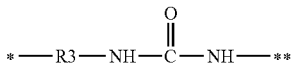

(X103)

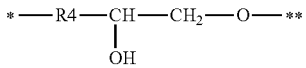

where R2 represents a linear or branched divalent hydrocarbon group, R3 represents a linear or branched divalent hydrocarbon group, R4 represents a linear or branched divalent hydrocarbon group, * represents a point of attachment to a nitrogen atom in formula (1), and ** represents a point of attachment to a carbon atom in a polymer chain forming the resin; and the electrophotographic member having a protrusion derived from the resin particle on an outer surface thereof, the resin particle comprising at least one of a urethane resin and a polyamide resin, wherein carbon black extracted from the resin layer has a BET specific surface area of 33 to 133 $m^2/g$, and DBP absorption amount at a 70% torque value in DBP absorption measurement of 42 to 90 ml/100 g, and $1468 \leq Z2/Z1 \leq 20175$ and $0.056 \leq Z3/(Z2 \cdot Z4) \leq 0.813$ when Z1 is an ionic equivalent (eq) of a resin of structural formula (1) contained in 1 part by mass of the resin layer, Z2 is a content (parts by mass) of the carbon black contained in 100 parts by mass of the resin layer, Z3 is a percentage (%) of the cross-sectional area of the resin particle in a cross-sectional area of the resin layer, and Z4 is d90 (μm) in a cumulative distribution of an area-equivalent diameter of the resin particle in the cross-sectional area of the resin layer.

2. The electrophotographic member according to claim 1, wherein [DBP absorption at maximum torque]−[DBP absorption at 30% torque] in DBP absorption measurement of the carbon black extracted from the resin layer is 40 ml/100 g or less.

3. The electrophotographic member according to claim 1, wherein the BET specific surface area is 50 to 90 $m^2/g$ as measured with respect to the carbon black, and DBP absorption measurement is 70 80 ml/100 g at a 70% torque value.

4. The electrophotographic member according to claim 1, wherein the carbon black has a pH of 4.5 or less.

5. The electrophotographic member according to claim 1, wherein the carbon black has a pH of 3.0 or more.

6. The electrophotographic member according to claim 1, wherein the urethane resin is a reaction product of an ionic compound having at least one member selected from the group consisting of hydroxyl group, amino group and glycidyl group in a quaternary ammonium cation structure, a polyisocyanate and a polymer polyol.

7. The electrophotographic member according to claim 6, wherein the ionic compound has a structure selected from the group consisting of formulae (IC-1) to (IC-6)

(IC-1)

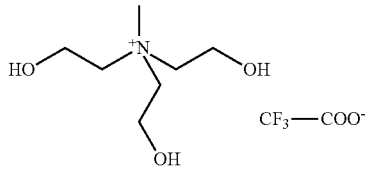

(IC-2)

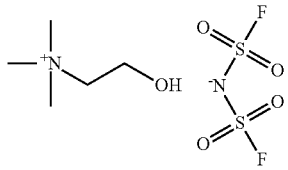

(IC-3)

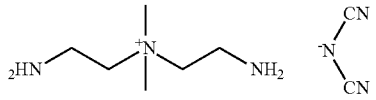

(IC-4)

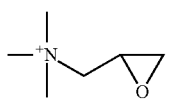

(IC-5)

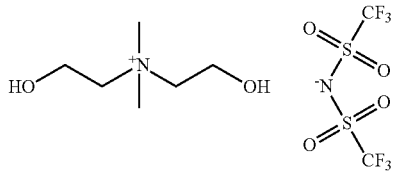

(IC-6)

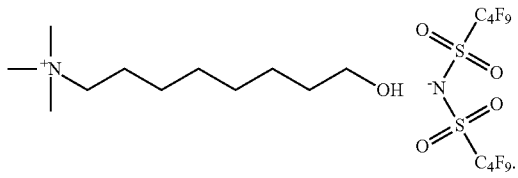

8. The electrophotographic member according to claim 1, wherein the electrophotographic member is a development member.

9. The electrophotographic member according to claim 1, wherein the electrophotographic member is a charging member.

10. The electrophotographic member according to claim 1, wherein the electrophotographic member is a cleaning member.

11. A process cartridge configured to be detachably attached to a main body of an electrophotographic image forming apparatus, the process cartridge comprising at least one electrophotographic member selected from the group consisting of a charging member, a development member and a cleaning member, the electrophotographic member comprises an electroconductive substrate and a resin layer as a surface layer on the substrate, the resin layer comprising a urethane resin having a structure of formula (1), an anion and a resin particle, the resin layer further comprising carbon black (1)

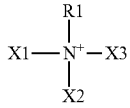

where, R1 represents a hydrogen atom, or a monovalent hydrocarbon group having 1 to 12 carbon atoms, X1 to X3 independently represent a structure selected from the group consisting of formulae (X101) to (X103), or a monovalent hydrocarbon group having 1 to 12 carbon atoms, with the proviso that at least one of X1 to X3 is one of formulae (X101) to (X103)

(X101)

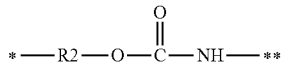

(X102)

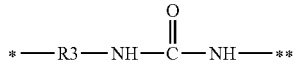

(X103)

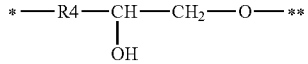

where R2 represents a linear or branched divalent hydrocarbon group, R3 represents a linear or branched divalent hydrocarbon group, R4 represents a linear or branched divalent hydrocarbon group, * represents a point of attachment to a nitrogen atom in formula (1), and ** represents a point of attachment to a carbon atom in a polymer chain forming the resin; and the electrophotographic member having a protrusion derived from the resin particle on an outer surface thereof, the resin particle comprising at least one of a urethane resin and a polyamide resin, wherein carbon black extracted from the resin layer has a BET specific surface area of 33 to 133 $m^2/g$, and DBP absorption amount at a 70% torque value in DBP absorption measurement of 42 to 90 ml/100 g, and $1468 \leq Z2/Z1 \leq 20175$ and $0.056 \leq Z3/(Z2 \cdot Z4) \leq 0.813$ when Z1 is an ionic equivalent (eq) of a resin of structural formula (1) contained in 1 part by mass of the resin layer, Z2 is a content (parts by mass) of the carbon black contained in 100 parts by mass of the resin layer, Z3 is a percentage (%) of the cross-sectional area of the resin particle in a cross-sectional area of the resin layer, and Z4 is d90 (μm) in a cumulative distribution of an area-equivalent diameter of the resin particle in the cross-sectional area of the resin layer.

12. An electrophotographic image forming apparatus, comprising:

an electrophotographic photosensitive member;

a charging member disposed such that the electrophotographic photosensitive member can be charged;

a development member; and a cleaning member, at least one of the charging member, the development member and the cleaning member being an electrophotographic member comprising an electro-conductive substrate, with a resin layer as a surface layer on the substrate, the resin layer comprising a urethane resin having a structure of formula (1), an anion and a resin particle, the resin layer further comprising carbon black (1)

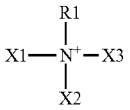

where R1 represents a hydrogen atom, or a monovalent hydrocarbon group having 1 to 12 carbon atoms, X1 to X3 independently represent a structure selected from the group consisting of formulae (X101) to (X103), or a monovalent hydrocarbon group having 1 to 12 carbon atoms, with the proviso that at least one of X1 to X3 is one of formulae (X101) to (X103)

(X101)

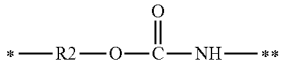

(X102)

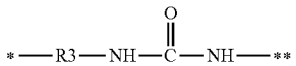

(X103)

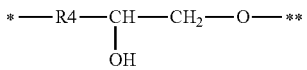

where R2 represents a linear or branched divalent hydrocarbon group, R3 represents a linear or branched divalent hydrocarbon group, R4 represents a linear or branched divalent hydrocarbon group, * represents a point of attachment to a nitrogen atom in formula (1), and ** represents a point of attachment to a carbon atom in a polymer chain forming the resin; and the electrophotographic member having a protrusion derived from the resin particle on an outer surface thereof, the resin particle comprising at least one of a urethane resin and a polyamide resin, wherein carbon black extracted from the resin layer has a BET specific surface area of 33 to 133 $m^2/g$, and DBP absorption amount at a 70% torque value in DBP absorption measurement of 42 to 90 ml/100 g, and $1468 \leq Z2/Z1 \leq 20175$ and $0.056 \leq Z3/(Z2 \cdot Z4) \leq 0.813$ when Z1 is an ionic equivalent (eq) of a resin of structural formula (1) contained in 1 part by mass of the resin layer, Z2 is a content (parts by mass) of the carbon black contained in 100 parts by mass of the resin layer, Z3 is a percentage (%) of the cross-sectional area of the resin particle in a cross-sectional area of the resin layer, and Z4 is d90 (μm) in a cumulative distribution of an area-equivalent diameter of the resin particle in the cross-sectional area of the resin layer.

* * * * *